US006365820B1

(12) United States Patent
Kondo et al.

(10) Patent No.: US 6,365,820 B1
(45) Date of Patent: Apr. 2, 2002

(54) KEYBOARD ASSEMBLY FOR ELECTRONIC MUSICAL INSTRUMENTS CAPABLE OF RECEIVING KEY TOUCH INPUTS AND GENERATING MUSICAL TONES THAT REFLECT A PLAYER'S POWER OF EXPRESSION

(75) Inventors: Masao Kondo; Junichi Mishima, both of Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/668,205

(22) Filed: Sep. 22, 2000

(30) Foreign Application Priority Data

Sep. 24, 1999 (JP) ..... 11-271402
Feb. 24, 2000 (JP) ..... 2000-048374

(51) Int. Cl.[7] ..... G10H 1/34

(52) U.S. Cl. ..... 84/658; 84/687; 84/719; 84/21; 84/DIG. 7

(58) Field of Search ..... 84/615, 626, 658, 84/687–690, 719, 720, 20–22, 115, DIG. 7

(56) References Cited

U.S. PATENT DOCUMENTS

| | | | |
|---|---|---|---|
| 4,217,803 | A | 8/1980 | Dodds |
| 4,273,017 | A | 6/1981 | Dodds et al. |
| 4,416,178 | A | 11/1983 | Ishida |
| 5,107,748 | A | 4/1992 | Muramatsu et al. |

FOREIGN PATENT DOCUMENTS

| | | |
|---|---|---|
| JP | 56-500055 | 1/1981 |
| JP | 57-104994 | 6/1982 |
| JP | 57-104995 | 6/1982 |
| JP | 1-321488 | 12/1989 |
| JP | 2-214897 | 8/1990 |

*Primary Examiner*—Stanley J. Witkowski
(74) *Attorney, Agent, or Firm*—Morrison & Foerster LLP

(57) ABSTRACT

A keyboard assembly for an electronic musical instrument is provided, which is capable of having touch inputs to a key from a finger of a player reflected in his power of expression with higher fidelity even when the single key is successively depressed to repeatedly generate the same tone. A plurality of mass members are each disposed to be pivotally driven in response to depression of the corresponding key. A support device pivotally supports the keys and the mass members. A plurality of musical tone instruction devices provided respectively for the keys each instruct generation and damping of a musical tone in response to depression of a corresponding key, and are each comprised of a first sensor and a second sensor for generating a key event during a stroke of the corresponding key in response to depression thereof or in response to pivotal movement of the corresponding mass member responsive to the depression of the key. The first sensor is activated in a first half of the key stroke to determine timing for damping of the musical tone, and the second sensor in a second half of the key stroke to determine timing for generation of the musical tone and further determine timing for determining a key velocity depending on a position of the key during the stroke relative to the support device.

30 Claims, 15 Drawing Sheets

FIG.13A

KEYBUF

| CHNo | KC(n) | KEY EVENT TYPE | Von(n) | Voff(n) |
|---|---|---|---|---|
| 0 | KC1 | 101B | | |
| 1 | KC2 | 010B | | |
| 2 | | | | |
| ⋮ | | | | |
| 15 | | | | |

FIG.13B

TCBUF

| CHNo | TC(n) |
|---|---|
| 0 | 01B |
| 1 | |
| ⋮ | ⋮ |
| n | ANY OF 00B, 01B AND 10B IS SET 11B IS NOT USED |
| ⋮ | ⋮ |
| 15 | |

FIG.13C

| CHNo | Ton(n) | Toff(n) |
|---|---|---|
| 0 | | |
| 1 | | |
| ⋮ | | |
| 15 | | |

KEYBOARD ASSEMBLY FOR ELECTRONIC MUSICAL INSTRUMENTS CAPABLE OF RECEIVING KEY TOUCH INPUTS AND GENERATING MUSICAL TONES THAT REFLECT A PLAYER'S POWER OF EXPRESSION

BACKGROUND OF THE INVENTION

1. Field of the Invention

This invention relates to a keyboard assembly for electronic musical instruments, which is provided with mass members each driven as a corresponding key is depressed, and detecting means for detecting a state of key depression, the keyboard being associated with an electronic musical instrument such that the latter generates musical tones in accordance with the detected state of the key depression.

2. Prior Art

Japanese Laid-Open Patent Publication (Kohyo) No. 56-500055 discloses a keyboard assembly for electronic musical instruments, which is provided with mass members each driven as a corresponding key is depressed, and detecting means for detecting a state of key depression, the keyboard being associated with an electronic musical instrument such that the latter generates musical tones in accordance with the detected state of the key depression.

FIG. 15 is a side view showing a structure of a combination of a single key with an electronic signal output unit in the above conventional keyboard assembly.

As shown in the figure, a jack 202 is provided on a rear end of a key 201 to push a mass member 203 upward, and a spring arm 204 is fixed at one end thereof to a rear end of the mass member 203, in a fashion extending from the rear end of the mass member 203. The spring arm 204 has a roller 205 attached to the other end thereof. The roller 205 is urged against a switch plate 207 which has an upper pressure-sensitive layer 206 to be urged by the roller 205.

When the key 201 is depressed, the mass member 203 is pushed upward by the jack 202, whereby the roller 205 urgingly slides on the switch plate 207 downward until the mass member 203 comes into contact with an arm stopper 208.

This conventional keyboard assembly is constructed such that key depression is not detected in regions close to the start and end points of a key stroke, because such regions are susceptible to erroneous touch and rebound, making the detection of key depressing operations unstable, but key depression is detected during a time period from a time point when the roller 205 reaches a first contact having a certain width and located at a substantially central portion of the switch plate 207 to a time point when the roller 205 reaches an initial end of a second contact having a certain width and also located at the substantially central portion of the switch plate 207.

According to the conventional keyboard assembly, however, key depression is detected only within the region located at the substantially central portion of the switch plate 207 as described above. Thus, when a single key is successively depressed to repeatedly generate the same tone, it is necessary to provide a deeper key stroke than that of a keyboard assembly for an acoustic piano, and a player feels uncomfortable with such a deep key stroke.

Further, for the same reason, the convectional keyboard assembly is not capable of detecting such a key depression as to generate musical tones in a wide dynamic range.

If the region for detecting key depression is increased, it seems that the conventional keyboard assembly will have a key stroke during successive key depressions closer to that of a keyboard assembly for an acoustic piano so that it is possible to detect a key depression having a wide dynamic range.

However, in the conventional keyboard assembly, the region for detecting key depression is required to be limited as mentioned above for the following reasons: (1) when an initial end of the first contact is changed to a shallower position in the key stroke, a key depression starts to be detected even when the key 201 is slightly touched, and conversely, when the initial end of the second contact is changed to a deeper position in the key stroke, the detection of the key depression is not completed unless the key 201 is depressed to the full degree; and (2) when the key 201 is hit strongly, the mass member 203 collides with the arm stopper 208 to become stopped, but at this moment, a felt part of the arm stopper 208 collapses and then recovers, and if the key is then kept depressed, the felt part becomes slightly collapsed again, and this causes the roller 205 to move to and fro (i.e. rebound) on the switch plate 207, and hence occurrence of chattering of the key due to rebound of the roller 205 must be suppressed.

Further, in the conventional keyboard assembly, the key depression/release operation timing and the tone generation/damping timing are slightly different from each other so that it is difficult to express delicacy as in acoustic pianos, particularly, grand piano.

SUMMARY OF THE INVENTION

It is a first object of the present invention to provide a keyboard assembly for an electronic musical instrument, which is capable of having touch inputs to a key from a finger of a player reflected in his power of expression with higher fidelity even when the single key is successively depressed to repeatedly generate the same tone.

It is a second object of the present invention to provide a keyboard assembly for an electronic musical instrument, which is capable of allowing the musical instrument to express delicacy as in acoustic pianos, particularly, grand piano.

To attain the first object, in a first aspect of the present invention, there is provided a keyboard assembly comprising a plurality of keys, a plurality of mass members each disposed to be pivotally driven in response to depression of a corresponding one of the plurality of keys, a support device that pivotally supports the plurality of keys and the mass members corresponding respectively to the keys, and a plurality of musical tone instruction devices that are provided respectively for the plurality of keys and each instruct generation and damping of a musical tone in response to depression of a corresponding one of the plurality of keys, wherein the musical tone instruction devices each comprise a first sensor and a second sensor for generating a key event during a stroke of the corresponding one of the keys in response to depression of the corresponding one of the keys or in response to pivotal movement of a corresponding one of the mass members responsive to the depression of the corresponding one of the keys, the first sensor being disposed to be activated in a first half of the stroke of the corresponding one of the keys to determine timing for damping of the musical tone, the second sensor being disposed to be activated in a second half of the stroke of the corresponding one of the keys to determine timing for generation of the musical tone, the second sensor further determining timing for determining a velocity of the corresponding one of the keys depending on a position of the corresponding one of the keys during the stroke relative to the support device.

The term "first half and second half of the key stroke" used herein does not mean a first half and a second half obtained by equally dividing the key stroke, but means more broadly, i.e. a first half and a second half obtained by dividing the key stroke at a desired ratio.

Further, the first and second sensors may be touch sensors or full-stroke sensors. When the full-stroke sensors are used, values detected during part of the full key stroke are used to determine the respective kinds of timing referred to above.

According to the arrangement of the first aspect, the first sensor which is activated in the first half of the key stroke determines the timing for damping a musical tone, and the second sensor which is activated in the second half of the key stroke determines not only the timing for generating a musical tone, but also the timing for determining the velocity of the corresponding one of said keys depending on the position of the corresponding key during the stroke relative to the support device. Therefore, to repeatedly generate the same tone, the key stroke need not extend to a position corresponding to the tone damping timing in the first half of the key stroke, but has only to extend to a position corresponding to predetermined timing in the latter half of the key stroke. Thus, the same musical tone can be repeatedly generated with ease. As a result, even when a player successively depresses the key to repeatedly generate the same tone, such successive touch inputs to the key from his finger can be reflected in his power of expression with higher fidelity.

To attain the first object, in a second aspect of the invention, there is provided a keyboard assembly comprising a plurality of keys, a plurality of mass members each disposed to be pivotally driven in response to depression of a corresponding one of the plurality of keys, a support device that pivotally supports the plurality of keys and the mass members corresponding respectively to the keys, and a plurality of sensor devices that are provided respectively for the plurality of keys and each instruct generation and damping of a musical tone in response to depression of a corresponding one of the plurality of keys, wherein the sensor devices each comprises a first position signal generator driven in a second half of a stroke of a corresponding one of the keys, for generating a first position signal indicative of a first position of the corresponding one of the keys in which an instruction for generation of a musical tone is to be given during depression of the corresponding one of the keys, when the corresponding one of the keys is located in the first position, a second position signal generator driven in the second half of the stroke of the corresponding one of the keys, for generating a second position signal indicative of a second position of the corresponding one of the keys in which a measurement of a depression velocity of the corresponding one of the keys is to be started during depression of the corresponding one of the keys, when the corresponding one of the keys is located in the second position, and a third position signal generator driven in a first half of the stroke of the corresponding one of the keys, for generating a third position signal indicative of a third position of the corresponding one of the keys in which an instruction for damping the musical tone is to be given during release of the corresponding one of the keys, when the corresponding one of the keys is located in the third position, the mass members being each arranged relative to the support device such that a limit position of the corresponding one of the keys in which the musical tone can be repeatedly generated due to a rebound of the mass member during generation of the musical tone is located farther from a position of the corresponding one of the keys in a released state than the second position.

According to the arrangement of the second aspect, the mass members are each arranged relative to the support device such that the limit position of each key in which a musical tone can be repeatedly generated due to a rebound of the mass member during generation of the musical tone is located farther from a position of the key in a released state than the second position. Therefore, occurrence of chattering during repeated generation of a musical tone can be suppressed, enabling the player to repeatedly generate the same tone easily. As a result, even when the player successively depresses a key to repeatedly generate a single tone, such successive touch inputs to the key from his finger can be reflected in his power of expression with still higher fidelity.

To attain the first object, in a third aspect of the invention, there is provided a keyboard assembly comprising a plurality of keys, a plurality of mass members each disposed to be pivotally driven in response to depression of a corresponding one of the plurality of keys, a support device that pivotally supports the plurality of keys and the mass members corresponding respectively to the keys, and a plurality of musical tone instruction devices that are provided respectively for the plurality of keys and each instruct generation and damping of a musical tone in response to depression of a corresponding one of the plurality of keys, wherein the musical tone instruction devices each comprise a first touch sensor and a second touch sensor that generate a key event during a stroke of the corresponding one of the keys in response to pivotal movement of a corresponding one of the mass members responsive to depression of the corresponding one of the keys, the first and second touch sensors each having a moving part and a fixed part, the second touch sensor being disposed to be activated in a second half of the stroke of the corresponding one of the keys, for generating a first timing related to musical tone generation, and a second timing related to musical tone generation corresponding to a shallower position of the corresponding one of the keys during the stroke than the first timing, the first touch sensor determining timing related to musical tone damping corresponding to a shallower position of the corresponding one of the keys during the stroke than the first timing, the moving part of at least one of the first and second touch sensors being driven by the corresponding one of the mass members, and the fixed part of the first touch sensor and the fixed part of the second touch sensor being arranged respectively on separate boards.

According to the arrangement of the third aspect, the movable part of at least one of the first and second touch switches is driven by a corresponding mass member. Therefore, the detection stroke can be made larger in terms of hammer stroke while it is kept smaller in terms of key stroke. This improves the sensing resolution of the detection stroke. Further, the fixed parts of the first and second touch switches are located on respective separate boards. Therefore, the degree of freedom in arranging the these switches is increased, which in turn increases the degree of freedom in improving the sensing resolution.

To attain the second object, in a fourth aspect of the present invention, there is provided a keyboard assembly comprising a plurality of keys, a plurality of mass members each disposed to be pivotally driven in response to depression of a corresponding one of the plurality of keys, a support device that pivotally supports the plurality of keys and the mass members corresponding respectively to the keys, and a plurality of musical tone instruction devices that are provided respectively for the plurality of keys and each instruct generation and damping of a musical tone in response to depression of a corresponding one of the plurality of keys, wherein one of the first sensor and the second sensor is activated by the corresponding one of the keys, and the other is activated by the corresponding one of the mass members.

According to the arrangement of the fourth aspect, one of the first sensor and the second sensor is activated by a corresponding key, and the other is activated by a corresponding mass member. Therefore, key events are generated during the stroke of the key in response to outputs from the sensors. As a result, it is possible to more accurately simulate tone generation timing and tone damping timing when keys of a keyboard of an acoustic piano, particularly a grand piano are depressed and released, thus allowing the musical instrument to express delicacy as in a grand piano.

The keyboard assembly for electronic musical instruments according to the present invention is not limited to the above described constructions, and further may be constructed as follows, for example:

A keyboard assembly comprising a plurality of keys, a plurality of mass members each disposed to be pivotally driven in response to depression of a corresponding one of the plurality of keys, a support device that pivotally supports the plurality of keys and the mass members corresponding respectively to the keys, and a plurality of musical tone instruction devices that are provided respectively for the plurality of keys and each instruct generation and damping of a musical tone in response to depression of a corresponding one of the plurality of keys, wherein the musical tone instruction devices each comprise a first sensor and a second sensor for generating a key event during a stroke of the corresponding one of the keys in response to depression of the corresponding one of the keys or in response to pivotal movement of a corresponding one of the mass members responsive to the depression of the corresponding one of the keys, the first sensor being disposed to be activated in a first half of the stroke of the corresponding one of the keys to determine timing for damping of the musical tone, the second sensor being disposed to be activated in a second half of the stroke of the corresponding one of the keys to determine timing for generation of the musical tone, the second sensor further determining timing for determining a velocity of the corresponding one of the keys depending on a position obtained by calculating a position of the corresponding one of the mass members during a depression stroke relative to the support device in terms of a position of the corresponding one of the keys.

A keyboard assembly comprising a plurality of keys, a plurality of mass members each disposed to be pivotally driven in response to depression of a corresponding one of the plurality of keys, a support device that pivotally supports the plurality of keys and the mass members corresponding respectively to the keys, and a plurality of musical tone instruction devices that are provided respectively for the plurality of keys and each instruct generation and damping of a musical tone in response to depression of a corresponding one of the plurality of keys, wherein the musical tone instruction devices each comprise a first sensor and a second sensor for generating a key depression event or a key release event during a stroke of the corresponding one of the keys in response to depression of the corresponding one of the keys or in response to pivotal movement of a corresponding one of the mass members responsive to the depression of the corresponding one of the keys, the first sensor being disposed to be activated in a first half of the stroke of the corresponding one of the keys to detect a third position which is a position of the corresponding one of the keys assumed during release, the second sensor being disposed to be activated by the corresponding one of the mass members in a second half of the stroke of the corresponding one of the keys to detect a first position which is a position of the corresponding one of the keys assumed during depression, and detect a second position which is closer than the first position and farther from a position of the corresponding one of the keys in a released state than the third position, the musical tone instruction devices each instructing generation of a corresponding musical tone when the second sensor detects the first position after detecting the second position, and preparing regeneration of the corresponding musical tone when the second sensor again detects the second position while generation of the corresponding musical tone is instructed.

A keyboard assembly comprising a plurality of keys, a plurality of mass members each disposed to be pivotally driven in response to depression of a corresponding one of the plurality of keys, a support device that pivotally supports the plurality of keys and the mass members corresponding respectively to the keys, and a plurality of musical tone instruction devices that are provided respectively for the plurality of keys and each instruct generation and damping of a musical tone in response to depression of a corresponding one of the plurality of keys, wherein the first sensor comprises a sensor driven by the corresponding one of the keys, for detecting release of the corresponding one of the keys, and the second sensor comprises a sensor driven by a corresponding one of the mass members, for detecting depression of the corresponding one of the keys.

The above and other objects of the invention will become more apparent from the following detailed description taken in conjunction with the accompanying drawings.

BRIEF DESCRIPTION OF THE DRAWINGS

FIGS. 13A to 13C are diagrams showing formats of buffer areas and a timer area allocated on a RAM appearing in FIG. 1, in which:

FIG. 13A shows a format of a buffer KEYBUF for storing tone generation information and tone damping information per channel;

FIG. 13B shows a format of a buffer TCBUF for storing a flag TC per channel; and FIG. 13C shows a format of software counter areas for measuring a key-on time and a key-off time per channel;

DETAILED DESCRIPTION OF PREFERRED EMBODIMENTS

The present invention will now be described in detail with reference to drawings showing preferred embodiments thereof.

Figure 1:
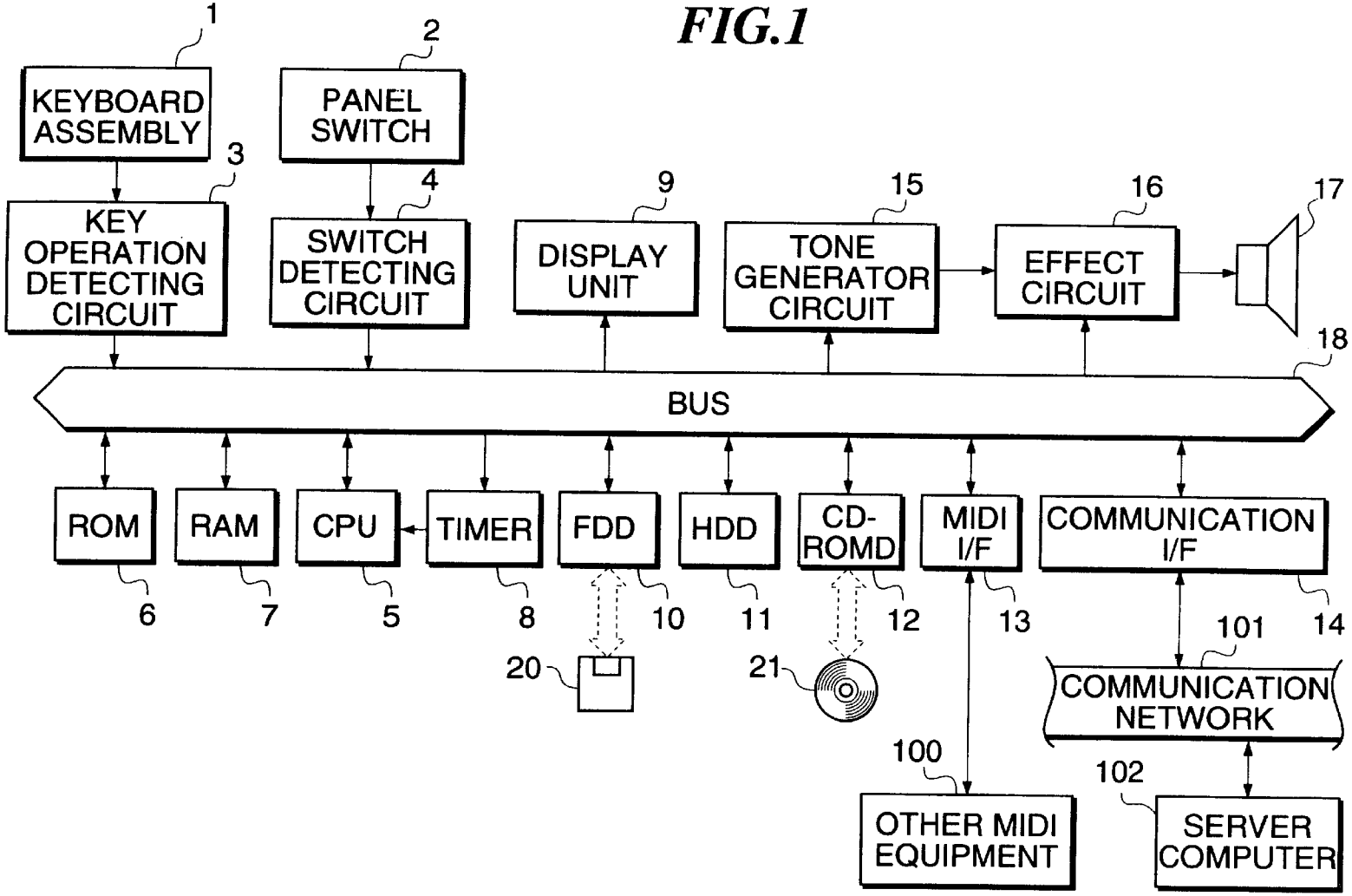
FIG. 1 is a block diagram showing the construction of an electronic musical instrument provided with a keyboard assembly according to an embodiment of the present invention.

FIG. 1 is a block diagram showing the construction of an electronic musical instrument provided with a keyboard assembly according to an embodiment of the present invention.

As shown in the figure, the electronic musical instrument to which the keyboard assembly according to this embodiment is applied is comprised of a keyboard assembly 1 for inputting pitch information, a panel switch 2 having a plurality of switches for inputting various information, a key operation-detecting circuit 3 for detecting depression of each of a plurality of keys of the keyboard assembly 1, a switch detecting circuit 4 for detecting depression of each switch on the panel switch 2, a CPU 5 for controlling the entire assembly, a ROM 6 storing a control program executed by the CPU 5 and various data such as table data, a RAM 7 for temporarily storing various data and information, such as performance data, various input information and computation results, a timer 8 for measuring an interrupt time and other times involved in a timer interrupt process, a display unit 9 provided with a large-sized liquid crystal display (LCD) or a CRT (cathode ray tube) display and light-emitting diodes (LEDs), a floppy disk drive (FDD) 10 for driving a floppy disk (FD) 20 as a storage medium, a hard disk drive (HDD) 11 for driving a hard disk, not shown, which stores not only application programs including the control program but also various data, a CD-ROM drive (CD-ROMD) 12 for driving a compact disk read-only memory (CD-ROM) 21 which stores various application programs including the above-mentioned control program and various data, a MIDI interface (I/F) 13 for inputting MIDI (Musical Instrument Digital Interface) signals and outputting MIDI signals to external devices, a communication interface (I/F) 14 for transmitting and receiving data to and from, for example, a server computer 102 via a communication network 101, a tone generator circuit 15 for converting performance data inputted from the keyboard assembly 1 or preset performance data into a musical tone signal, an effect circuit 16 for imparting various acoustic effects to a musical tone signal from the tone generator circuit 15, and a sound system 17 including a DAC (digital-to-analog converter), an amplifier and speakers for converting a musical tone signal from the effect circuit 16 into acoustic sounds.

The above constituent components 3 to 16 are connected with each other via a bus 18. The timer 8 is connected to the CPU 5, the MIDI I/F 13 to the other MIDI equipment 100, the communication I/F 14 to the communication network 101, the tone generator circuit 15 to the effect circuit 16, and the effect circuit 16 to the sound system 17.

The hard disk incorporated in the HDD 11 can also store the control program to be executed by the CPU 5, as described above. If the control program is not stored in the ROM 6, it can be stored in the hard disk and read therefrom into the RAM 7, whereby the CPU 5 can perform the same operation as if the control program were stored in the ROM 6. This operation allows a user to make additions to the control program and update its version easily, for example.

The control program and data read from the CD-ROM 21 loaded into the CD-ROM drive 12 are stored in the hard disk within the HDD 11. This operation enables the user to newly install a control program and update its version easily, for example. In addition to the CD-ROM drive 12, other external storage devices including a magneto-optical disk (MO) unit may be provided in order to utilize various types of media.

The MIDI I/F 13 is not limited to a dedicated one, but may be a general-purpose interface, such as the RS232C, the USB (Universal Serial Bus) and the IEEE1394. In the latter case, MIDI messages may be transmitted or received together with other data simultaneously.

As described above, the communication I/F 14 is connected to the communication network 101, such as a LAN (Local Area Network), the Internet or a telephone line, for connection to the server computer 102 via the communication network 101. When the above programs and various parameters are not stored in the hard disk built in the HDD 11, the communication I/F 14 is used to download these programs and parameters from the server computer 102. A computer, which is a client (the electronic musical instrument in this embodiment), transmits a command requesting to download the programs and parameters in question to the server computer 102 via the communication I/F 14 and the communication network 101. In response to this command, the server computer 102 sends the requested programs and parameters to the computer via the communication network 101. When the computer receives these programs and parameters via the communication I/F 14 and stores them in the hard disk within the HDD 11, the downloading is completed.

Additional interfaces may be provided for direct data communication with external computers and the like.

Although, as can be understood from the above description, the electronic musical instrument applied to this embodiment is built on a general-purpose personal computer, this is not limitative, but it may be built on a dedicated apparatus comprised solely of such minimum components as required to embody the present invention.

Figure 2A:
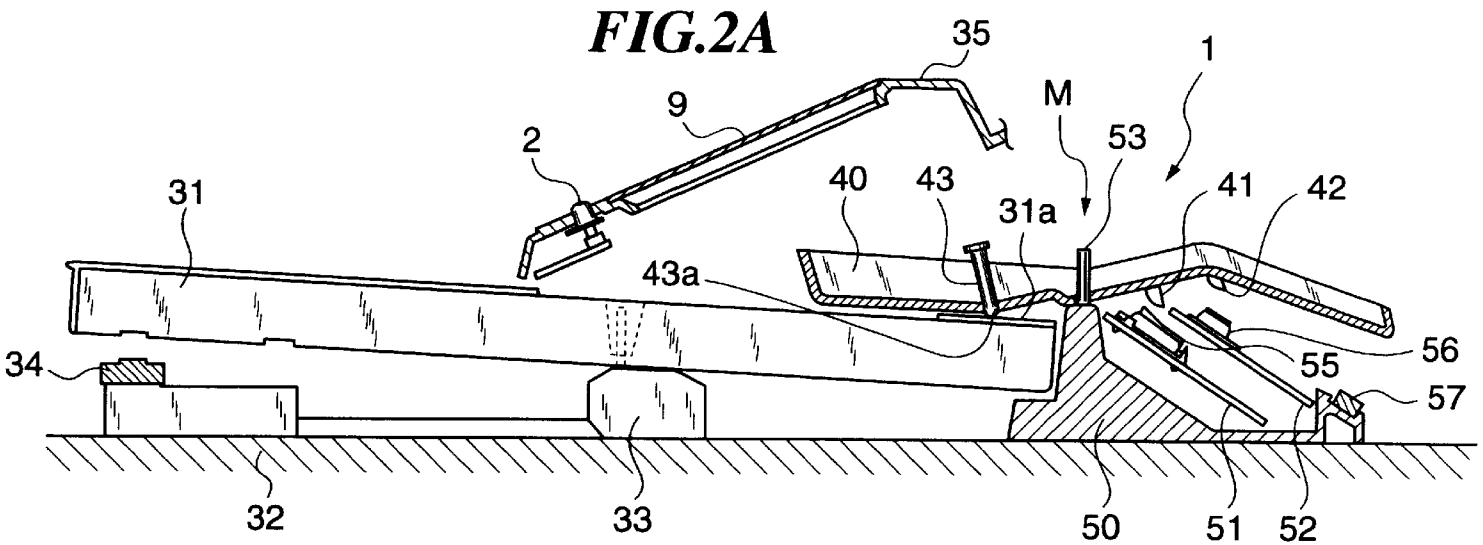
FIG. 2A is a sectional view showing the construction of the keyboard assembly of FIG. 1, in a state where a key is not depressed.
Figure 2B:
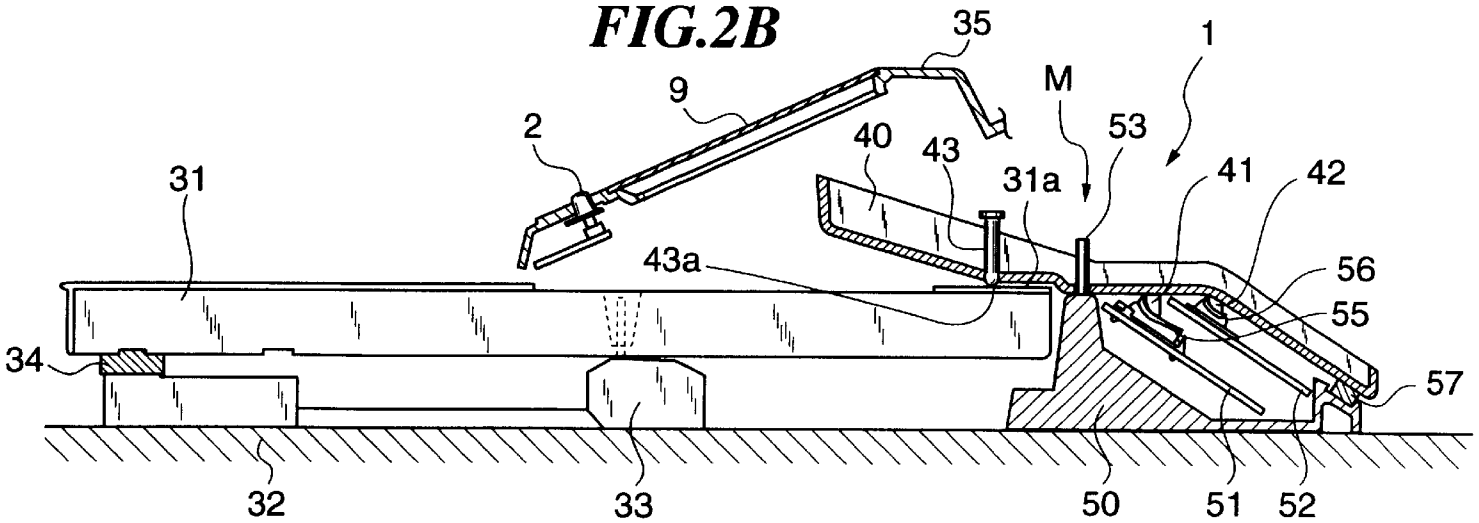
FIG. 2B is a sectional view showing the construction of the same keyboard assembly, in a state where the key is depressed.

FIGS. 2A and 2B are sectional views showing the construction of the keyboard assembly 1 according to this embodiment, in which FIG. 2A shows a state where a key is not depressed, and FIG. 2B shows a state where the key is depressed. While these figures depict the states of a white key, the same applies to a black key. In this embodiment, a player side is referred to as "front" or "forward".

The keyboard assembly 1 is comprised of a plurality of seesaw-type keys 31 to be depressed, and a plurality of mass members 40, each driven by a corresponding one of the keys 31 and pivotally moved by a corresponding one of fulcrum mechanisms (mass member fulcrum mechanisms) M. The fulcrum mechanisms M are comprised mainly of a mass member support member 50 provided on a shelf board 32 at rear portions of the keys 31, and a plurality of fulcrum pins 53 projecting from top of the mass member support member 50 in a fashion corresponding to the respective keys 31.

A key support member 33 is mounted on the shelf board 32 and pivotally supports the plurality of keys 31 and their corresponding mass members 40 in key depressing/releasing directions. A stopper 34 comes into contact with a corresponding key 31 to determine an extreme end or limit position (FIG. 2B) when the key 31 is depressed. A rear end portion of each key 31 has an upper side surface thereof smoothed, thus functioning as a driving portion 31*a* for driving a corresponding mass member 40.

Each mass member 40 has a mass large enough to obtain an appropriate inertia force when the corresponding key 31 is depressed, and the mass is distributed such that the center of gravity of the mass member is located mainly at a location forward of the corresponding fulcrum mechanism M. A tone generation position adjusting screw 43 is provided at a location forward of the fulcrum mechanism M of each mass member 40. A lower end portion of the tone generation position adjusting screw 43 functions as a follower 43*a* for contact with the driving portion 31*a* of the corresponding key 31. When the key 31 is depressed, its driving portion 31*a* comes into contact with the follower 43*a* to pivotally move the mass member 40. The tone generation position adjusting screw 43 serves to adjust an amount of pivotal movement of the mass member 40 in relation to tone generation timing thereof.

A portion of the mass member 40 which is located rearward of the fulcrum mechanism M is bent first upward and then downward, and has a first actuator section 41 and a second actuator section 42 downwardly projected on a lower side surface thereof. Provided below a rear half portion of the mass member 40 are a first switch board 51 and a second switch board 52. A first switch section 55 and a second switch section 56 are mounted respectively on the first switch board 51 and the second switch board 52, in a manner corresponding to each key 31. Each of the first and second switch sections 55 and 56 is a two-make touch response switch of a contact time difference type made of rubber as a resilient resin material. It is so designed that in executing a key depression stroke, first the first actuator section 41 first comes into contact with the first switch section 55, followed by the second actuator section 42 coming into contact with the second switch section 56.

As can be surmised from FIGS. 2A and 2B, the first switch board 51 and the second switch board 52 are substantially the same in shape, and they share their wiring, particularly, their wiring from the power supply, in common. By taking advantage of this feature, the two switch boards can be made of so-called split boards, which are prepared by perforating a single board so that two switch boards can be obtained from the respective split boards, connecting by a jumper power supply lines to the two switch boards to be obtained, and then separating the resulting single board at the perforation to thereby obtain two separate switch boards. If this manufacturing process of the switch boards is adopted, the manufacturing cost can be curtailed.

In this embodiment, the first switch section 55 is used for detecting a key-on state and the second switch section 56 is used for detecting a key-off state by using a predetermined algorithm, described hereinafter with reference to FIGS. 8 and 9, and the resulting detected key-on/key-off state signals are used for designating musical tones.

As described above, according to this embodiment, the driving of the first switch section 55 which is located closer to the fulcrum mechanism M precedes that of the second switch section 56 which is located farther away from the fulcrum mechanism M, to thereby ensure a stable operation. This is because, in the arrangement in which the actuator sections 41 and 42 are kept apart from each other, if it is so designed that the switch sections 55 and 56 are driven in a reverse order to that described above, the operation sometimes becomes unstable and hence undesirable.

Further, the switches are driven in the order of closeness to the fulcrum mechanism M, with the actuator sections 41 and 42 kept sufficiently distant from each other. Therefore, the accuracy of tone generation timing and other timings can be improved. That is, in the case where the switch sections 55 and 56 are arranged at locations corresponding to timing of string striking by a hammer in a piano, for example, even if such locations are somewhat deviated from where they should be on the side of the mass member 40, the influence of such deviation would be negligible when exerted on a corresponding key 31. Therefore, even though the fabrication accuracy of the switch sections 55 and 56 is not so high, if a tone-generation control processing system employing a combination of these switches is constructed, the tone-generation position accuracy, and hence the touch response accuracy can be improved.

A stopper 57 is provided at a location rearward of the first switch board 51. The stopper 57 is brought into contact with a rear end portion of the mass member 40 during its pivotal movement, to thereby serve as a damper for the mass member 40. A panel section 35 is located above the keys 31 and provided with the panel switches 2 and the display unit 9.

Figure 3A:
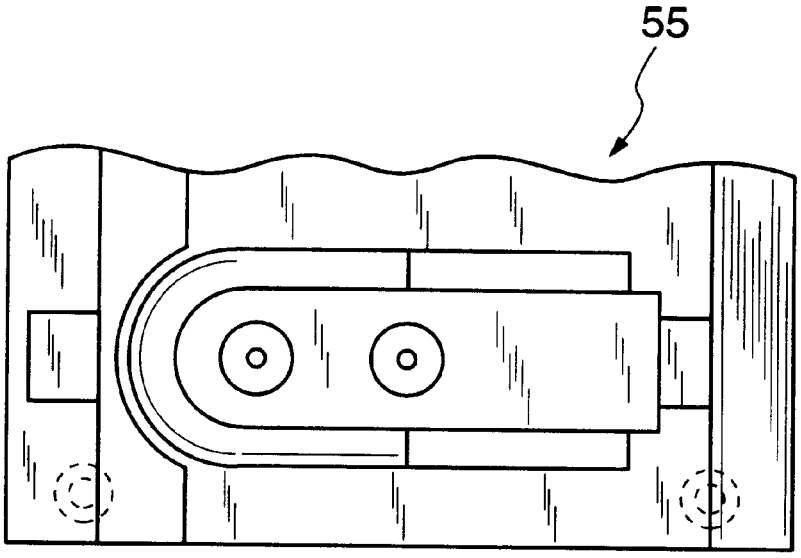
FIG. 3A is an enlarged fragmentary top view showing an essential part of a first switch appearing in FIGS. 2A and 2B.
Figure 3B:
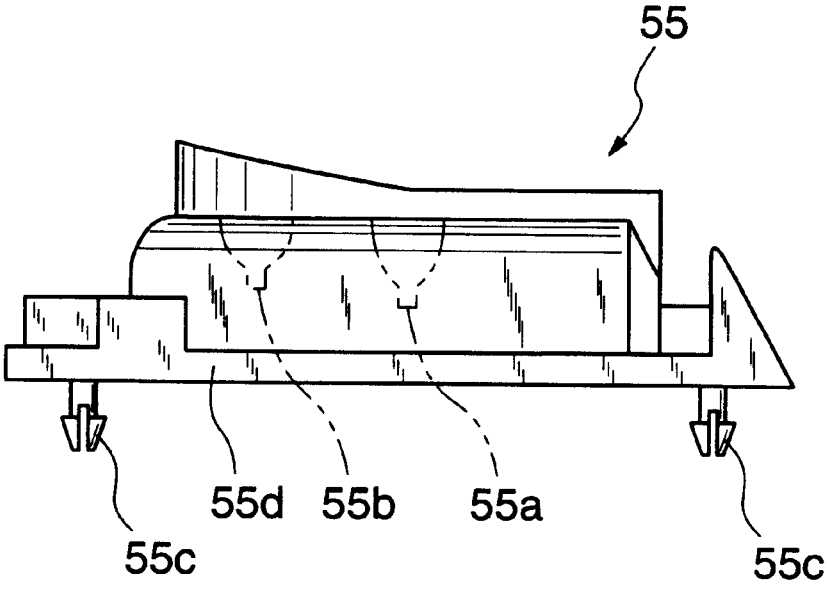
FIG. 3B is an enlarged fragmentary side view showing the essential part of the first switch appearing in FIGS. 2A and 2B.
Figure 4A:
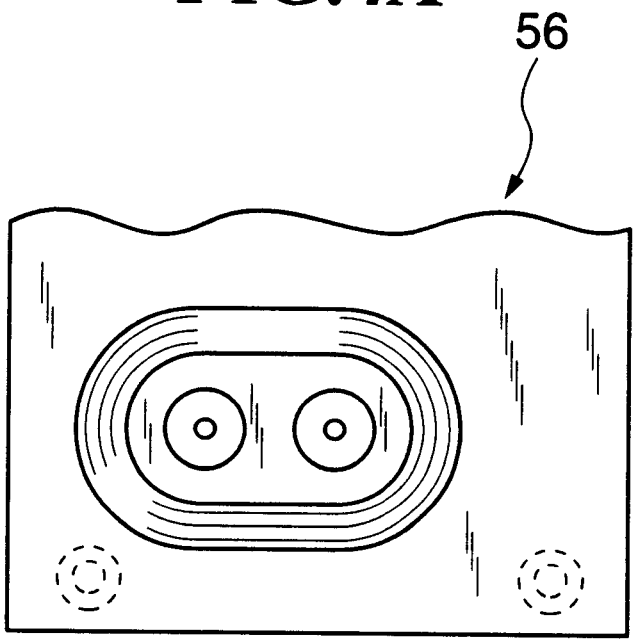
FIG. 4A is an enlarged fragmentary top view showing an essential part of a second switch appearing in FIGS. 2A and 2B.
Figure 4B:
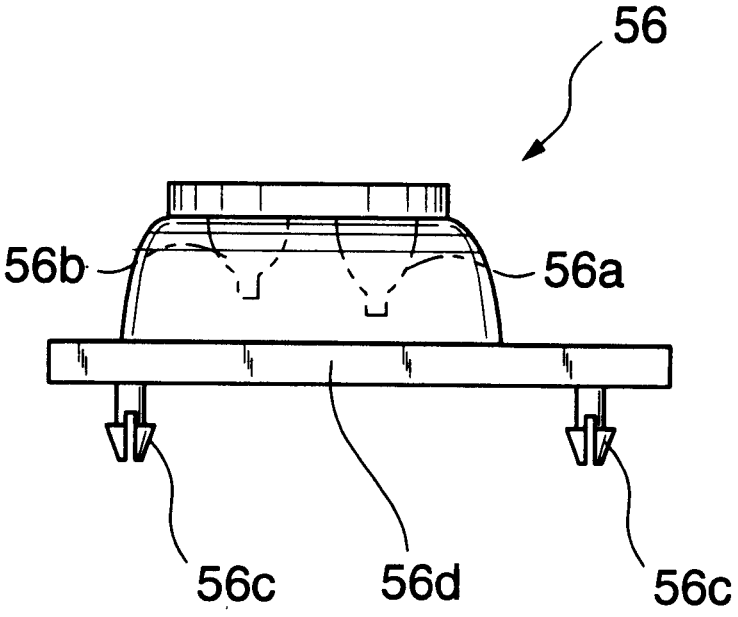
FIG. 4B is an enlarged fragmentary side view showing the essential part of the second switch appearing in FIGS. 2A and 2B.

FIGS. 3A, 3B, and 4A, 4B are enlarged fragmentary views respectively showing essential parts of the first and second switch sections 55 and 56, in which FIGS. 3A and 4A are top views of the same and FIGS. 3B and 4B are side views of the same.

In FIG. 3B, the first switch section 55, which is a two-make touch response switch as described above, is a contact unit comprised of a movable contact member formed of rubber as a resilient resin material and having integrally formed therein a first switch (movable contact) 55*a* and a second switch (movable contact) 55*b*, and a base 55*d* serving as a fixed contact member having fixed contacts for the first and second switches 55*a*, 55*b*. The first and second switches 55*a*, 55*b* are disposed such that the first switch 55*a* is first turned on and then the second switch 55*b* is turned on with a delay when the first actuator section 41 is brought into contact with a contact surface of the first switch section 55 to push down the contact surface of the section 55.

FIGS. 3A and 3B show only a part of the first switch section 55 with which the first actuator section corresponding to a single key (mass member) is brought into contact. Actually, a plurality of first switch sections 55, one of which is shown in these figures, are similarly arranged in a fashion corresponding to a plurality of keys (mass members), respectively. FIGS. 3A and 3B show one end portion of the thus arranged first switch section 55.

Further, the first switch section 55 has a plurality of projections 55*c* formed thereon for fixing the same to the first switch board 51. These projections 55*c* are inserted into holes, not shown, formed in the first switch board 51 at locations corresponding thereto, to thereby fix the first switch section 55 to the first switch board 51.

The second switch section 56, which is also a two-make touch response switch as described above, is a contact unit comprised of a movable contact member formed of rubber as a resilient resin material and having integrally formed therein a first switch (movable contact) 56*a* and a second switch (movable contact) 56*b*, and a base 56*d* serving as a fixed contact member having fixed contacts for the first and second switches 56*a*, 56*b*. The first and second switches 56*a*, 56*b* are disposed such that the first switch 56*a* is first turned on and then the second switch 56*b* is turned on with a delay, similarly to the first switch section 55. The second switch section 56 also has a plurality of projections 56*c* formed thereon for fixing the same to the second switch board 52.

The first switch section 55 is distinguished from the second switch section 56 in the following points: The first switch section 55 has a sloped contact surface for helping a corresponding contact surface of the first actuator section 41 smoothly slide thereon, while the second switch section 56 has a flat contact surface which is not sloped; and the second switch section 56 has such a structure as to buckle to an extent enough to be felt by a player when its contact surface is pushed down, while the first switch section 55 has no such structure.

Figure 5:
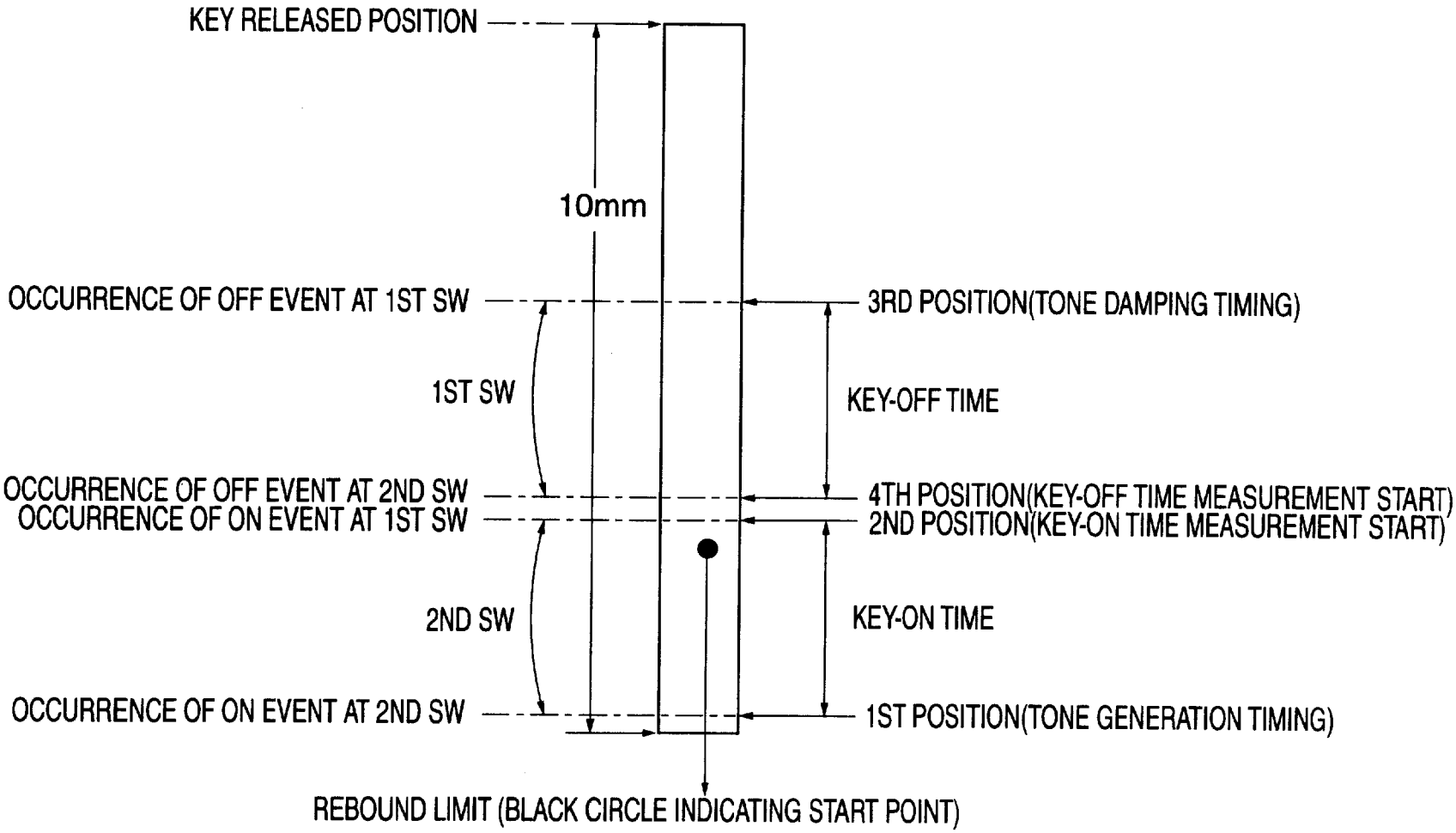
FIG. 5 is a diagram showing on positions assumed by switches of the switches of FIGS. 3A, 3B, 4A and 4B in executing a full key stroke.

FIG. 5 shows on positions (timings) assumed by the switches 55*a*, 55*b*, 56*a* and 56*b* of the switch sections 55 and 56 in relation to a key stroke in executing a full key stroke.

As shown in the figure, each key of the keyboard assembly 1 can move a maximum distance of 10 mm vertically from a key released position to a key depressed position which is the deepest position. As the key is moved on its depression stroke, first, the first switch 55*a* of the first switch section 55 turns on at a third position, and then the second switch 55*b* of the same turns on at a fourth position. The first switch 56*a* of the second switch section 56 then turns on at a second position, and finally, the second switch 56*b* of the same turns on at a first position. Thus, factors, such as the position of the mass member 40 relative to the mass member support member 50, the configurations of the first and second actuator sections 41 and 42, the configurations of the first and second switch sections 55 and 56, and the locations of the first and second switch boards 51 and 52, are determined so that these switches 55*a*, 55*b*, 56*a* and 56*b* can sequentially turn on in the above-mentioned order, i.e. so that the first switch 56*a* of the second switch section 56 cannot turn on before the second switch 55*b* of the first switch section 55 turns on.

The third position is set as a position that determines tone damping timing (timing for instructing the tone generator circuit 15 to damp a musical tone), the fourth position a position that determines timing for starting measurement of a key-off time, the second position a position that determines timing for starting measurement of a key-on time, and the first position a position that determines tone generation timing (timing for instructing the tone generator circuit 15 to damp a musical tone). That is, the key-off time is measured during a time period from the fourth position to the third position (the key-off time determines a key-off velocity (musical tone damping velocity), as referred to hereinafter), and the key-on time is measured during a time period from the second position to the first position (the key-on time determines a key-on velocity, as referred to hereinafter). This means that when a key is depressed to a position deeper than the first position to generate a musical tone, if the same musical tone is to be generated again, the player is only required to return the key to the second position and then depress the same key to the first position. In other words, it is not required that the key be returned to the third position to generate the same musical tone again. Therefore, this allows touch inputs to a key from a finger of a player to be reflected in his power of expression with higher fidelity.

Further, while according to the prior art, as described before, the mass member 40 rebounds as the corresponding key is depressed, according to this embodiment, a limit position of the rebound is set to a position deeper than the second position and shallower than the first position, as shown in FIG. 5. That is, the rebound limit position is set within a time interval during which key depression is detected, and hence a key depression having a wide dynamic range can be detected. Furthermore, since the rebound limit position is set to a position deeper than the second position, even if the mass member 40 reaches its maximum rebound position, no generation of the same tone is instructed again. In other words, the keyboard assembly of the invention has such a structure that occurrence of chattering due to a rebound of each mass member 40 is suppressed. This makes it unnecessary to add a process for eliminating chattering to the key process, thereby simplifying the key process.

Although the keyboard assembly according to the present embodiment has the above described construction as an example, the keyboard assembly according to the invention is not limited to this.

For example, the present invention can be realized by changing the location of only one of the first and second switch sections 55 and 56 to a location where it can come into contact with an actuator section provided on a substantially central portion of a front half of the key 31, while the other switch remains located at the same location in the above embodiment.

Further, the present invention can also be realized by changing the location of only one of the first and second switch sections 55 and 56 to a location where it can come into contact with an actuator section provided on a substantially central portion of a rear half of the key 31, while the other switch remains located at the same location in the above embodiment, and then setting a switch event logic applied to the first and second switches of such one of the switches reverse to a switch event logic applied to the keyboard assembly 1 according to the above embodiment.

Still further, the present invention can be realized by arranging one of the first and second switch sections 55 and 56 at a location where it can come into contact with an actuator section provided on a substantially central portion of the front half of the key 31, arranging the other switch at a location where it can come into contact with an actuator section provided on a substantially central portion of the rear half of the key 31, and then setting a switch event logic of such other switch reverse to a switch event logic applied to the keyboard assembly 1 according to the above embodiment.

Furthermore, the present invention can even be realized by omitting a rear half of each mass member 40 and providing a frame extending from the mass member support member 50 so as to cover the mass member 40, arranging the first and second switch sections 55 and 56 inside the frame such that contact surfaces thereof face the mass member 40, and arranging the first and second actuator sections on a surface of the mass member 40 remote from the corresponding key 31 such that the first and second actuator sections can be brought into contact with the first and second switch sections 55 and 56, respectively.

Figure 6:
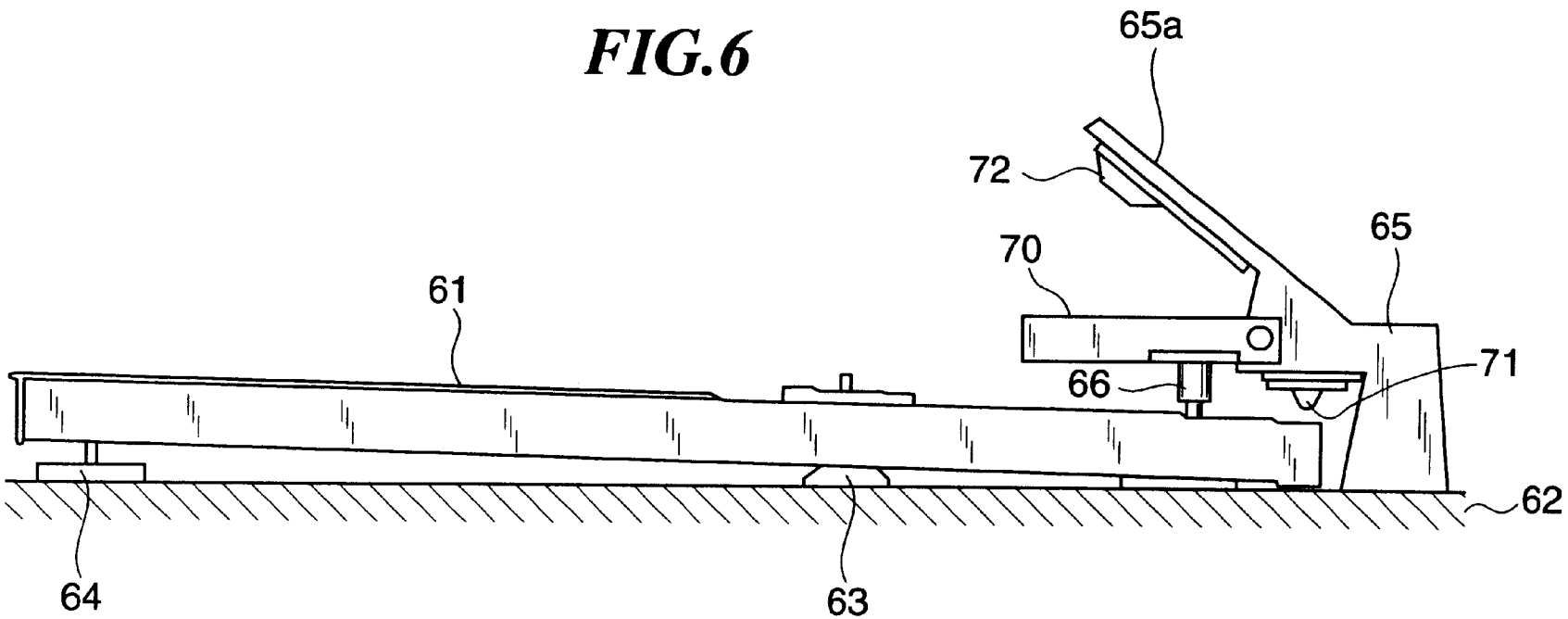
FIG. 6 is a sectional view showing the construction of a keyboard assembly according to another embodiment of the present invention.

Moreover, as shown in FIG. 6, the present invention can be also realized by providing a first switch 71 on a support member 65 that supports a mass member 70 such that the latter can pivotally move upward, at a location where it can come into contact with a rear end portion of a key 61, and providing a second switch 72 on an arm portion 65*a* formed on the support member 65, at a location where it can come into contact with a front end portion of the mass member 70.

Figure 7:
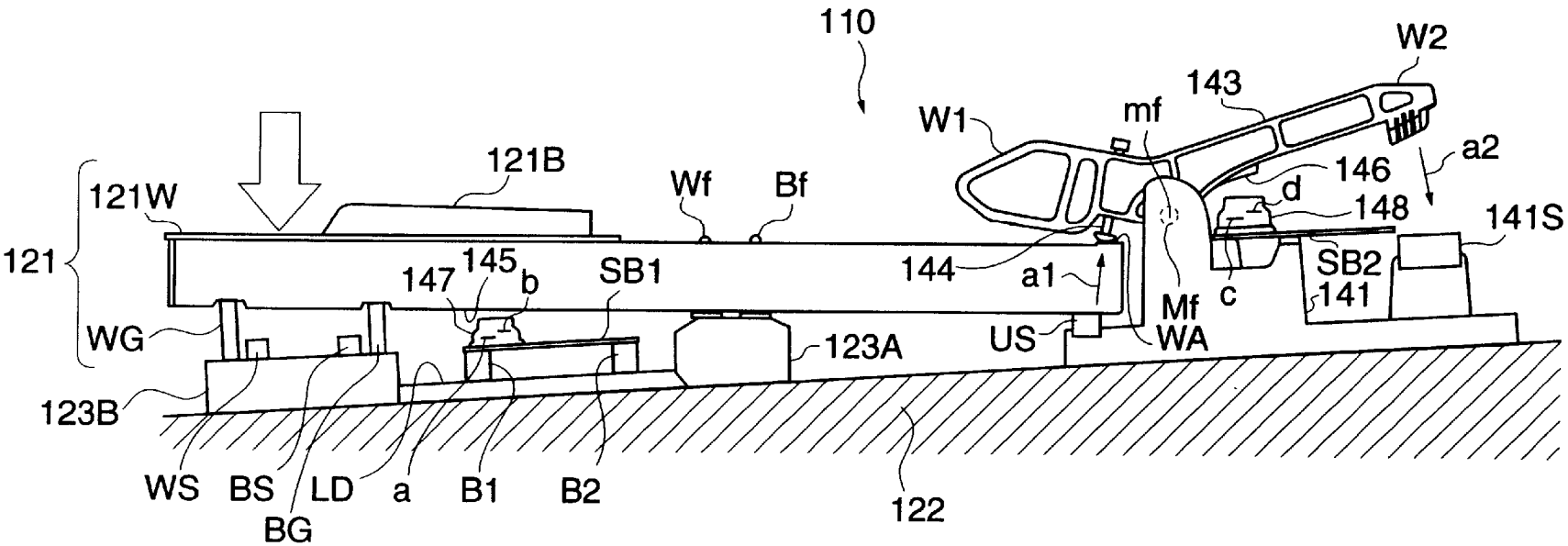
FIG. 7 is a sectional view showing the construction of a keyboard assembly according to still another embodiment of the present invention.

FIG. 7 is a sectional view showing the construction of a keyboard assembly according to still another embodiment of the present invention. In the figure, the keyboard assembly 110 is very schematically illustrated as viewed from a lateral side, with one of keys thereof shown as being in a released state.

The keyboard assembly 110 in FIG. 7 is comprised of a plurality of keys 121 consisting of white keys 121W and black keys 121B, and a plurality of mass members 143 each disposed to be pivotally driven in response to depression of a corresponding one of the keys 121. Fixed on a shelf board 122 of the musical instrument are a main key support member 123A and an auxiliary key support member 123B which constitute a key support section 123. The main key support member 123A has fulcrum pins Wf and Bf, and the white keys 121W are pivotally supported by the support member 123A via the respective corresponding fulcrum pins Wf, and the black keys 121B via the respective corresponding fulcrum pins Bf. Provided at a front portion (a left portion as viewed in FIG. 7) of each key 121 are key guides WG and BG projected from the auxiliary key support member 123B for guiding the white key 121W and the black key 121B when these keys are separately depressed or released. A lower limit stopper WS for the white key and a lower limit stopper BS for the black key are provided on the auxiliary key support member 123B.

Connecting members LD are securely joined to or formed integrally with the main key support member 123A and the auxiliary key support member 123B to connect them together and present a ladder-like configuration as viewed from above. At a location above the connecting members LD and below the key 12, a board SB1 with a first switch (SW) 147 having a construction similar to the one shown in FIGS. 3A and 3B, mounted thereon is arranged on the shelf board 122 via support members B1 and B2. At a rear side of the key 121, a mass member support member 141 having a fulcrum Mf is fixed on the shelf board 122. A resin-made mass member 143 having weights W1 and W2 is pivotally supported at a fulcrum mf thereof by the fulcrum Mf of the support member 141, whereby the mass member 143 is supported by the support member 141. An upper limit stopper US is provided on a front portion of the support member 141, and a stopper 141S on a rear portion of the same.

The mass member 143 is disposed relative to the key 121 such that it can be driven by a mass member driving portion WA provided on a rear end of the key 121 via a force transmission member 144. The force transmission member 144 is formed of a screw and serves not only to transmit a force to the mass member 143 when the key is depressed, but also to finely adjust a tone generation position, hereinafter referred to. The mass member driving portion WA of the key 121 has a smoothed surface. At a location below the mass member 143, a board SB2 is placed on an upper side surface of the mass member support member 141, on which is mounted a mass member driven switch 148 constituting a second switch (SW) having a construction similar to the one shown in FIGS. 4A and 4B. In a released position, the key 121W (121B) remains stationary in contact with the upper limit stopper US, and when depressed, it is brought into contact with the stopper WS (BS) at a front portion thereof, and at the same time the mass member 143 is brought into contact with the stopper 141S at a lower edge of a rear portion thereof. At this time, the degree of collision of the mass member 143 is mitigated by the stopper 141S to reduce mechanical noises.

At this time, the mass member 143 indents the stopper 141S which is formed of a buffer material due to the inertia action of the weights W1 and W2 and then stops. During a slight time period immediately after the mass member 143 thus stops, a rebound phenomenon of the mass member 143 occurs. Therefore, in order to prevent repeated generation of the same tone due to the rebound phenomenon, the keyboard assembly according to the present invention as claimed in claim 20 is constructed such that a movable contact c, hereinafter referred to, is disposed to remain in contact with a corresponding fixed contact, not shown. More specifically, when the key stopper WS (BS) and the mass member stopper 141S collide with the key 121W (121B) and the mass member 143, respectively, which would otherwise cause a physical rebound of the mass member 143, it is so constructed in terms of the materials of the stoppers WS (BS) and 141S that the mass member 143 is prevented from undergoing a physical rebound until the second switch 148, which is turned off only when the key 121W (121B) is deeply depressed, comes into a position where it becomes fully closed (turned off). In other words, the mass member 143 is arranged relative to its support member 141 such that a limit position of the key for repeated generation of a musical tone due to a rebound of the mass member at the time of generation of the same tone is set to a position farther from a position of the key in a released state than the aforementioned second position (refer to FIG. 5).

With the above arrangement, when the key is depressed in a downward direction as indicated by an arrow on a left side of FIG. 7, the rear portion of the key 121 and the front portion of the mass member 143 are pivotally moved upward as indicated by an arrow a2 on a central portion of the figure, and at the same time the the rear portion of the mass member 143 pivotally moves downward as indicated by an arrow a2 on a right side of the figure. When the key is released, the key 121 and the mass member 143 are pivotally moved in respective reverse directions to the above directions indicated by the arrows, into the respective original positions as illustrated.

In the keyboard assembly 110 according to the present embodiment, key depression and release strokes are detected by the first and second switches (SWs) 147, 148. In the example of FIG. 7, first and second actuator sections 145 and 146 are provided on lower side surfaces of the key 121 and the mass member 143, respectively, such that the first and second switches 147, 148, each having two contacts, are driven by these actuator sections.

Here, the actuator sections 145, 146 and the switches 147, 148 are arranged relative to each other in such a relationship that during the key depression stroke, first, the first actuator section 145 comes into contact with the first switch 147, and then the second actuator section 146 comes into contact with the second switch 148 with a delay. Each of the first and second switches 147, 148 is a two-make touch response switch of a contact time difference type made of rubber (resilient resin material), which has a pair of contacts a and b; c and d with a difference in stroke before a closed (ON) position and an open (OFF) position.

More specifically, in the first switch 147, when the first actuator section 145 comes into contact with the switch 147, for example, the first contact a is first closed (turned on) to start an ON section of the first switch 147 (i.e. an operative or operation-continued section in which only one contact is closed), and then the second contact b is closed to terminate the ON section of the first switch 147. This is the same with the second switch 148, that is, when in the key depression stroke the second actuator section 146 comes into contact with the switch 148, for example, the first contact c of the second switch 148 is first closed to start an ON section of the second switch 148, and then the second contact d is closed to terminate the ON section of the second switch 148. On the other hand, in the key release stroke, reversely to the above, the contacts are sequentially opened in the order of d of the first switch 148→c of the same→b of the second switch 147→a of the same.

As described above, according to the keyboard assembly 110 of the present embodiment, key depression information is detected by the second switch 148, and key release information is detected by the first switch 147, more specifically, the key depression information is detected when the second switch 148 is activated by the second actuator section 146 provided on the mass member 143, and the key release information is detected when the first switch 147 is activated by the first actuator section 145 provided on the key 121. The key depression information and the key release information cooperate to generate a touch response signal, based on which tone generation control is performed.

In general, in an acoustic piano, transmission of a force occurs in the order of key→hammer action mechanism→hammer→string. On this occasion, a damper mechanism operates as a string-damping mechanism in response to the key operation. When depression of the key is started, a felt part of the damper becomes detached from the string, and the felt part comes into contact with the string immediately before the completion of the following key release operation.

In the tone generation/damping mechanism constructed as above, only a force generated at the time of hitting of the hammer against the string is reflected in the power of performance expression, while a behavior of the key action other than the above time of hitting of the hammer does not appreciably affect the power of performance expression. However, the manner of key release or repeated generation of a musical tone immediately after the completion of the key release operation can realize a delicate expression. If the key is returned to a position where the jack head can push upward the hammer roller (a slightly released position such as the second position in FIG. 5 in terms of the key position), repeated generation of the musical tone can be realized. At this time, as the vibration of the string is greater, the damper felt part acts to slightly suppress the string vibration at earlier timing in the key release stroke, and then the damper felt part completely suppresses the string vibration at the completion of the key release operation to damp the musical tone. Thus, depending on the key release technique, it is possible to delicately change the tone color.

Referring again to the present embodiment, inertia information of the mass member which is an inertial member having a large travel distance is obtained as key velocity based on a contact time difference of the two-make switch which is driven by the mass member, that is, obtained as ideal key depression information. Further, key release information is obtained from the switch which detects a release action of the key which travels through a shorter distance than the mass member. Therefore, control (e.g. musical tone control) based on the key release information obtained by a key release operation can be reproduced more really. That is, also in the case of carrying out, for example, control of determining a position of the key at which switching is to be made to a musical tone which is generated when the damper felt part is in half contact with the string, performance expression can be realized with a feeling conforming to an acoustic piano. In other words, a trial to realize such performance expression using a switch driven by the key alone or a switch driven by the mass member alone can bring about a feeling different from a feeling of playing an acoustic piano and is ridiculous. Further, according to the present embodiment, repeated generation of a musical tone can be achieved without requiring a large key release stroke, whereas, only complete damping of a musical tone is carried out by a large key release stroke, which matches the principle of an acoustic piano.

By the above described reasons, with the keyboard assembly according to the present embodiment, it is possible to more accurately simulate tone generation timing and tone damping timing when keys of a keyboard of an acoustic piano, particularly a grand piano are depressed and released, thus allowing the musical instrument to express delicacy as in a grand piano.

Now, a control process which is performed by the thus constructed electronic musical instrument will be described below in detail with reference to FIGS. 8 to 14B.

Figure 8:
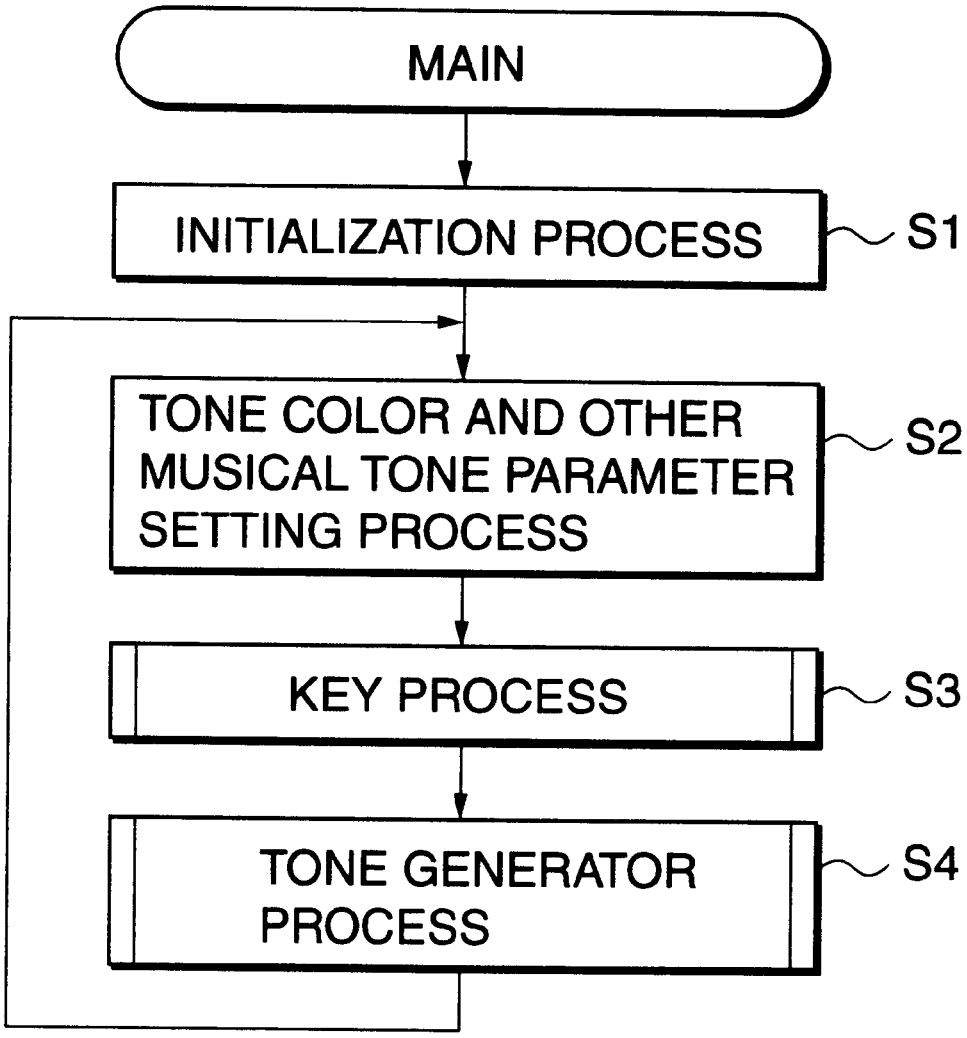
FIG. 8 is a flowchart showing the procedure of a main routine executed by the electronic musical instrument, particularly by a CPU, appearing in FIG. 1.

FIG. 8 is a flowchart showing the procedure of a main routine executed by the electronic musical instrument, particularly, by the CPU 5.

In the figure, first, an initialization process is executed (step S1). This process includes operations of clearing of the RAM 7 including buffers KEYBUF and TCBUF, and counter areas Ton(n) and Toff(n) (where n is an integral ranging from 0 to 15), referred to hereinafter with reference to FIGS. 13A to 13C, and setting of musical tone parameters, such as default tempo and default tone color.

Next, a musical tone parameter setting process is executed (step S2). When the player designates a musical tone parameter for tone color, for example, this process sets the designated parameter to a corresponding register or the like within the tone generator circuit 15.

Then, a key process subroutine (step S3) and a tone generator process subroutine (step S4) are executed, after which the CPU 5 returns to a step S2 to repeat the processes in steps S2 to S4. In the key process subroutine (described hereinafter in detail with reference to FIGS. 9 and 10), the CPU 5 captures various tone generation information or tone damping information as the player depresses or releases keys on the keyboard assembly 1 and sends the received tone generation information or tone damping information to the tone generator circuit 15, to thereby instruct the tone generator circuit 15 to perform a tone generation operation or a tone damping operation. In the tone generator process subroutine (described hereinafter in detail with reference to FIG. 11), the CPU 5 causes the tone generator circuit 15 to start a tone generation operation or a tone damping operation in response to an instruction for performing a tone generation or tone damping operation given during the key process.

Further, concurrently with this main routine, the CPU 5 executes a timer interrupt process (described hereinafter in detail with reference to FIG. 12). This process is started in response to a timer interrupt signal generated by the timer 8 at predetermined time intervals (e.g. every 5 μsec).

Figure 9:
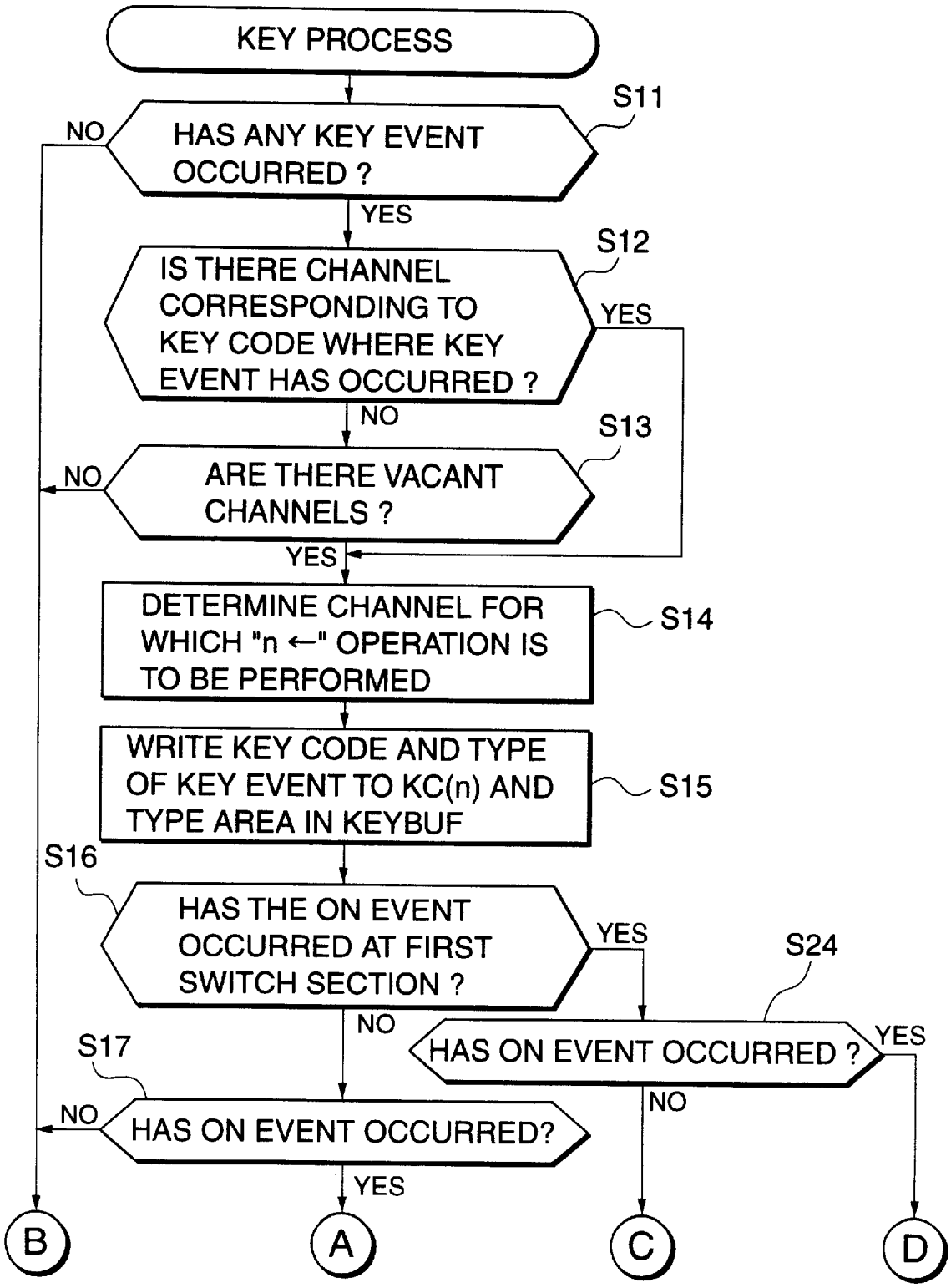
FIG. 9 is a flowchart showing in detail the procedure of a key process subroutine appearing in FIG. 8.
Figure 10:
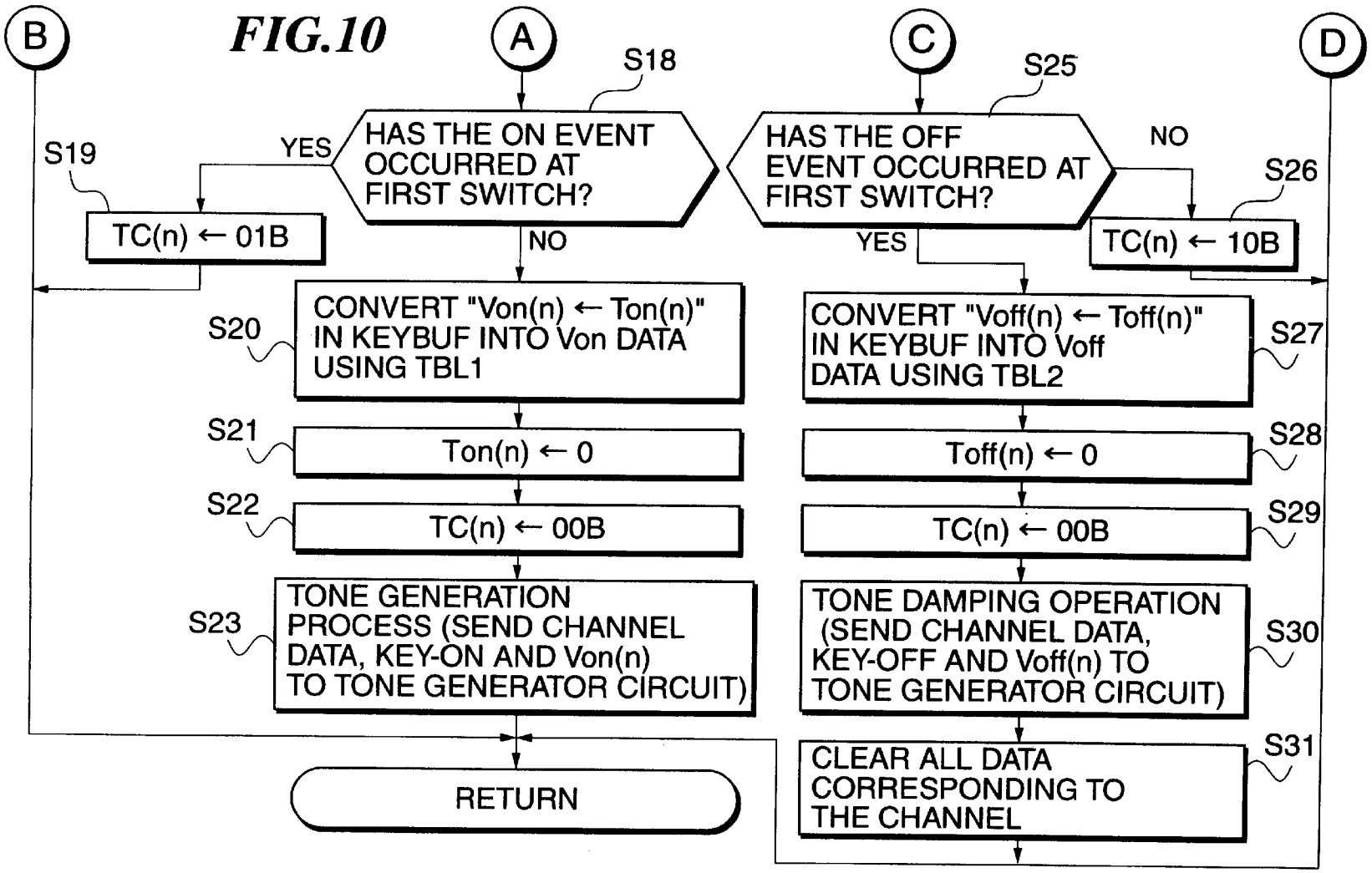
FIG. 10 is a flowchart showing a continuation of the key process subroutine of FIG. 9.

FIGS. 9 and 10 are a flowchart showing in detail the procedure of the key process subroutine which is executed at the step S3.

The key process will be outlined with reference to FIG. 5, before giving its detailed description with reference to this flowchart.

The key process is roughly comprised of: (a) a process for single key depressing operation (the term "single key depressing operation" is used in contrast to "a successive key depressing operation"; the same applies hereinafter); (2) a process for a successive key depressing operation; (3) a process for a key releasing operation; and (4) a process common to the processes (1) to (3).

In the process (1) for a single-strike key depressing operation, (i) an operation of determining a key-on time measurement start timing (second position), and (ii) an operation of determining a tone generation timing (first position) and executing tone generation are performed. In the process (3) for a key releasing operation, (iii) an operation of determining a key-off time measurement start timing (fourth position), and (iv) an operation of determining a tone damping timing (third position) and an operation of tone damping are performed. In the process (4) common to the processes (1) to (3), (v) an operation of determining a tone generation channel is executed. In the process (2) for a successive key depressing operation, all steps involved in the process (1) for a single-strike key depressing operation are carried out, except that a path to be followed during the common process (4) is different from that of the process (1).

In FIGS. 9 and 10, the operation (i) of determining a key-on time measurement start timing is executed by following a path of steps S16→S17→S18→S19→Return. In this case, the operation (v) of determining a tone generation channel is executed by following a path of steps S11→S12→S13→S14→S15→S16.

More specifically, first, it is determined whether or not a key event has occurred (step S11). The term "key event" used herein means an on event or an off event. There are four types of on events, which are activated by a total of four switches, i.e. the first and second switches 55*a*, 55*b* of the first switch section 55 and the first and second switches 56*a*, 56*b* of the second switch section 56. Similarly, there are four types of off events activated by the same switches. Therefore, it is necessary to identify a total of eight types of key events, and these eight types of key events are identified in this embodiment by a method described hereinafter. Note that each key event is detected by a subroutine, not shown, which is independent of this key process, and this key process uses only detected results (the detection is carried out by constantly checking an on or off state of each of the four switches and detecting a timing at which a change occurs in the on/off state of the switch and a direction of such change).

Next, it is determined whether or not there is a channel CH storing a key code KC of a key of which the key event has occurred (step S12).

FIGS. 13A to 13C respectively show formats of buffer areas and a timer area reserved in the RAM 7, in which FIG. 13A shows a format of the buffer KEYBUF for storing tone generation information and tone damping information per channel, FIG. 13B shows a format of the buffer TCBUF for storing a flag TC per channel, and FIG. 13C shows a format of software counter areas for measuring a key-on time and a key-off time per channel.

In FIG. 13A, the buffer KEYBUF consists of an area KC(n) for storing key code data, a type area for storing key event type data, an area Von(n) for storing key-on velocity data and an area Voff(n) for storing key-off velocity data, for each of sixteen tone generation channels (CH0–CH15).

The "key event type data" is used to identify the above eight types of key events, and consists of three bits. That is, when the third bit is 0, it indicates the first switch section 55, while when the same bit is 1, it indicates the second switch section 56. When the second bit is 0, it indicates a first switch, while when the same bit is 1, it indicates a second switch. When the first bit is 0, it indicates an on event, while when the same bit is 1, it indicates an off event. More specifically, the key event type data for the 0th channel in FIG. 13A is 101B (where "MB" is a symbol indicating that the value preceding it is a binary number; the same applies hereinafter), and this indicates a key-off event of the first switch 56*a* of the second switch section 56. The key event type data for the first channel is 010B, and this indicates a key-on event of the second switch 55*b* of the first switch section 55.

Next, it is determined whether or not there are vacant channels (step S13). A vacant channel is determined by whether or not key code data is stored in any of the areas KC(n) in the buffer KEYBUF. Any channel where key code data is not stored is a vacant channel.

When vacant channels are found in step S13, the CPU selects a channel to assign a tone generation operation, and stores the selected channel in an area n reserved in the RAM 7 (contents stored in this area n will hereinafter be referred to as "the channel n") (step S14).

Further, the CPU 5 also stores the key code data and key event type of the key event in question in an area KC(n) and a type area corresponding to the channel n, respectively.

Then, when the key event in question is an on event of the first switch 56*a* of the second switch section 56, i.e. when a key event type corresponding to the channel n is 100B, the CPU 5 sets 01B to a flag TC(n) corresponding to the channel n, starting a key-on time measurement (steps S16→S17→S18→S19 Return).

The operation (ii) of determining tone generation timing and executing tone generation is executed by following a path of steps S16→S17→S18→S20→S21→S22→S23→Return. In this case, the operation (v) of determining a tone generation channel is executed by following the same path as that described above with respect to the operation (i).

That is, when the key event in question is an on event of the second switch of the second switch section 56, i.e. when a key event type corresponding to the channel n is 110B, the CPU 5 converts a count value equivalent to a key-on time stored in an area Ton(n) corresponding to the channel n into a key-on velocity value Von using a Ton(n)-to-Von conversion table (TBL1) shown in FIG. 13A, stores the obtained key-on velocity value Von in an area Von(n) corresponding to the channel n (step S20), and resets the area Ton(n) and the flag TC(n) (Ton(n)←0, TC(n)←00B) (steps S21 and S22), to thereby perform the tone generation operation (step S23).

The term "tone generation operation" in the key process means, specifically, an operation of sending to the tone generator circuit 15 channel data (tone generation channel data and key code data), "KEY-ON", i.e. an instruction for tone generation, and a key-on velocity value Von(n).

The operation (iii) of determining a key-off time measurement start timing is executed by following a path of steps S16→S24→S25→S26→Return. In this case, the operation (v) of determining a tone generation channel is executed by following a path of steps S11→S12→S14→S15→S16.

That is, in the operation (v), the determining step S13 is bypassed (steps S11→S12→S14), because in the instant case there already exists a channel CH which stores a key code KC of a key of which a key event, which is an on event, has occurred. More specifically, the existence of such a channel CH means that areas in the buffer KEYBUF, such as the key code area and the key event type area, are available for such a channel CH to perform related operations. Hence, there is no need to determine a new tone generation channel in step S13. While skipping the step S13, the CPU 5 then stores, in step S14, the above channel CH storing the key code KC at which the key event has occurred as the channel n.

In step S15, the CPU 5 stores the key code data and key event type of the key event in question in the area KC(n) and the type area corresponding to the channel n, respectively, as described before. In this case, however, since the key code data has already been stored in the area KC(n), the same key code data is overwritten in the area KC(n), while the key event type data, which has also been stored in the type area, is updated with data whose first bit is different.

When the key event in question is an off event of the first switch of the first switch section 55, i.e. when the key event type corresponding to the channel n is 001B, the CPU 5 sets 10B to a flag TC(n) corresponding to the channel n, starting a key-off time measurement (steps S16→S24→S25→S26→Return).

The operation (iv) of determining a tone damping timing and executing tone damping is executed by following a path of steps S16→S24→S25→S27→S28→S29→S30→S31→Return. In this case, the operation (v) of determining a tone generation channel is executed by following the same path as that described above with respect to the operation (iii).

Figure 14A:
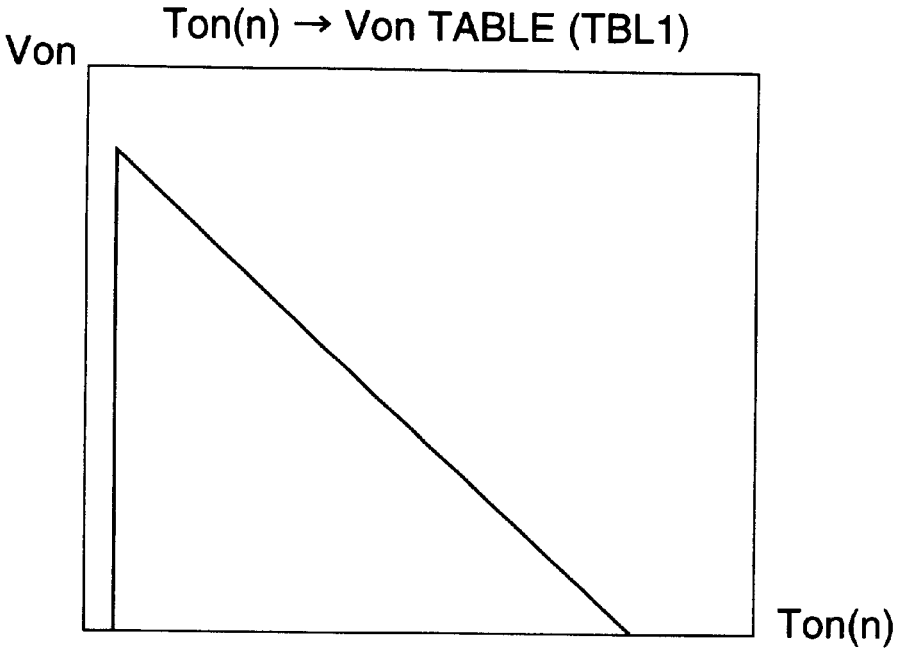
FIG. 14A is a diagram showing an example of a conversion table for converting the key-on time into key-on velocity.
Figure 14B:
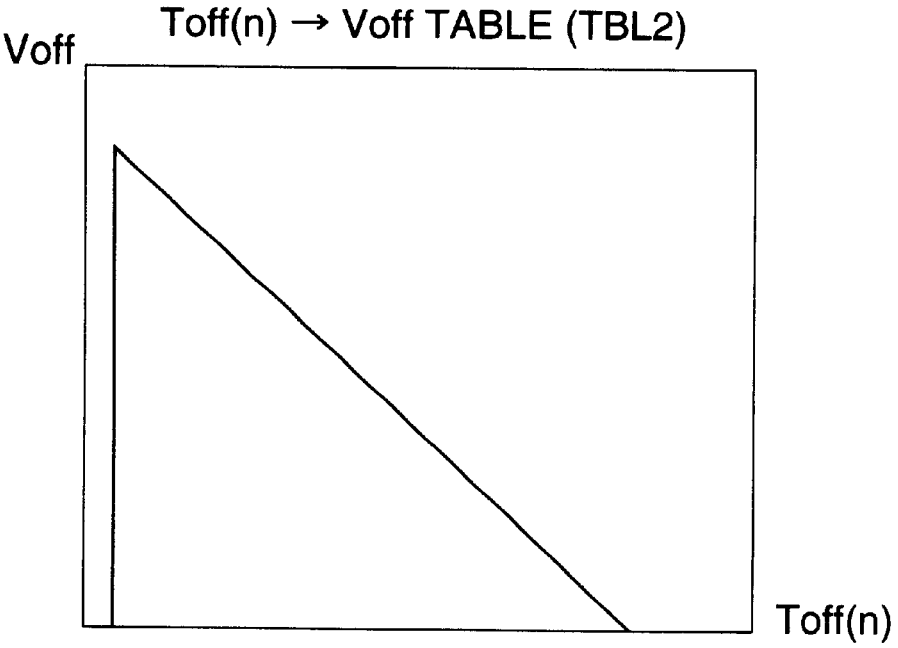
FIG. 14B is a diagram showing an example of a conversion table for converting the key-off time into key-off velocity.
Figure 15:
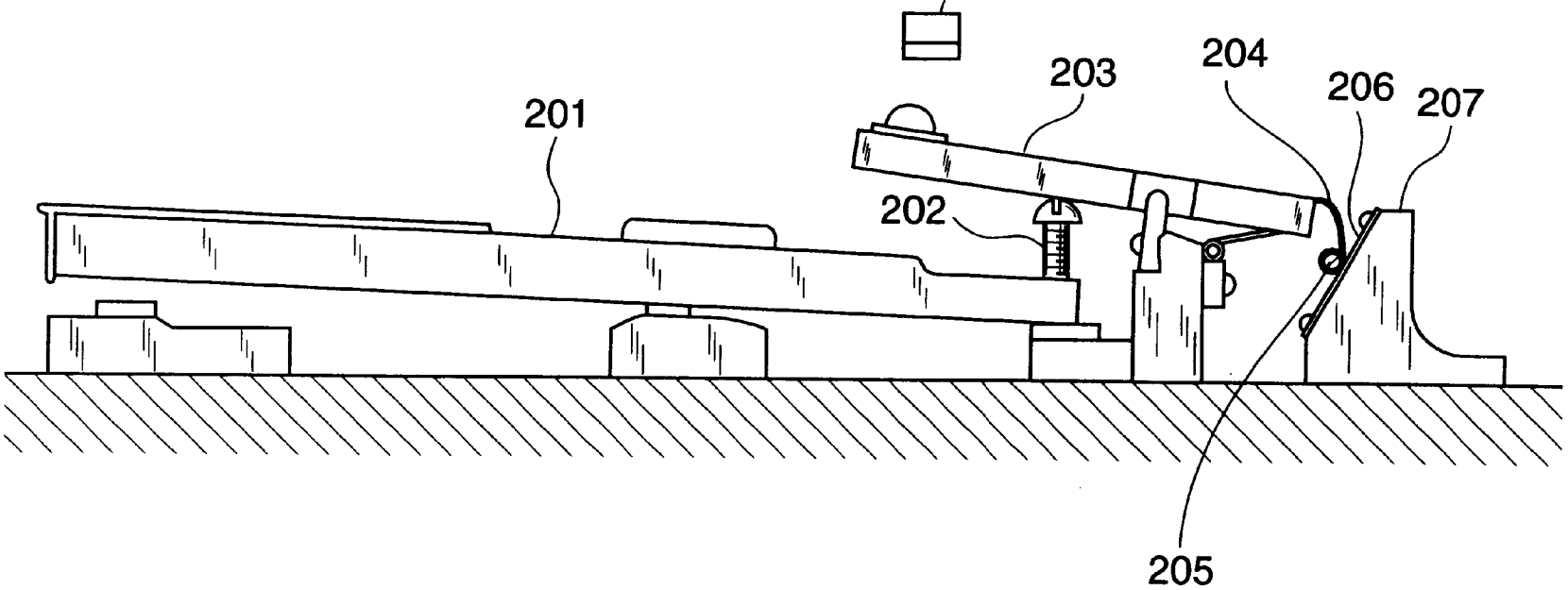
FIG.15 PRIOR ART
FIG. 15 is a side view showing a structure of a combination of a single key with an electrical signal output unit in a conventional keyboard assembly.

That is, when the key event in question is an off event of the first switch of the first switch section 55, i.e. when a key event type corresponding to the channel n is 001B, the CPU 5 converts a count value equivalent to a key-off time stored in an area Toff(n) corresponding to the channel n into a key-off velocity value Voff using a Toff(n)-to-Voff conversion table (TBL2) shown in FIG. 14B, stores the obtained key-off velocity value Voff in an area Voff(n) corresponding to the channel n (step S27), resets the area Toff(n) and the flag TC(n) corresponding to the channel n (T0ff(n)←0, TC(n)←00B) (steps S28 and S29), performs a tone damping process (step S30), and clears all the data corresponding to the channel n in the buffer KEYBUF (step S31).

The term "tone damping operation" in the key process means, specifically, an operation of sending to the tone generator circuit 15 channel data (tone generation channel data and key code data), "KEY-OFF" or an instruction for tone damping, and a key-off velocity value Voff (n).

Figure 11:
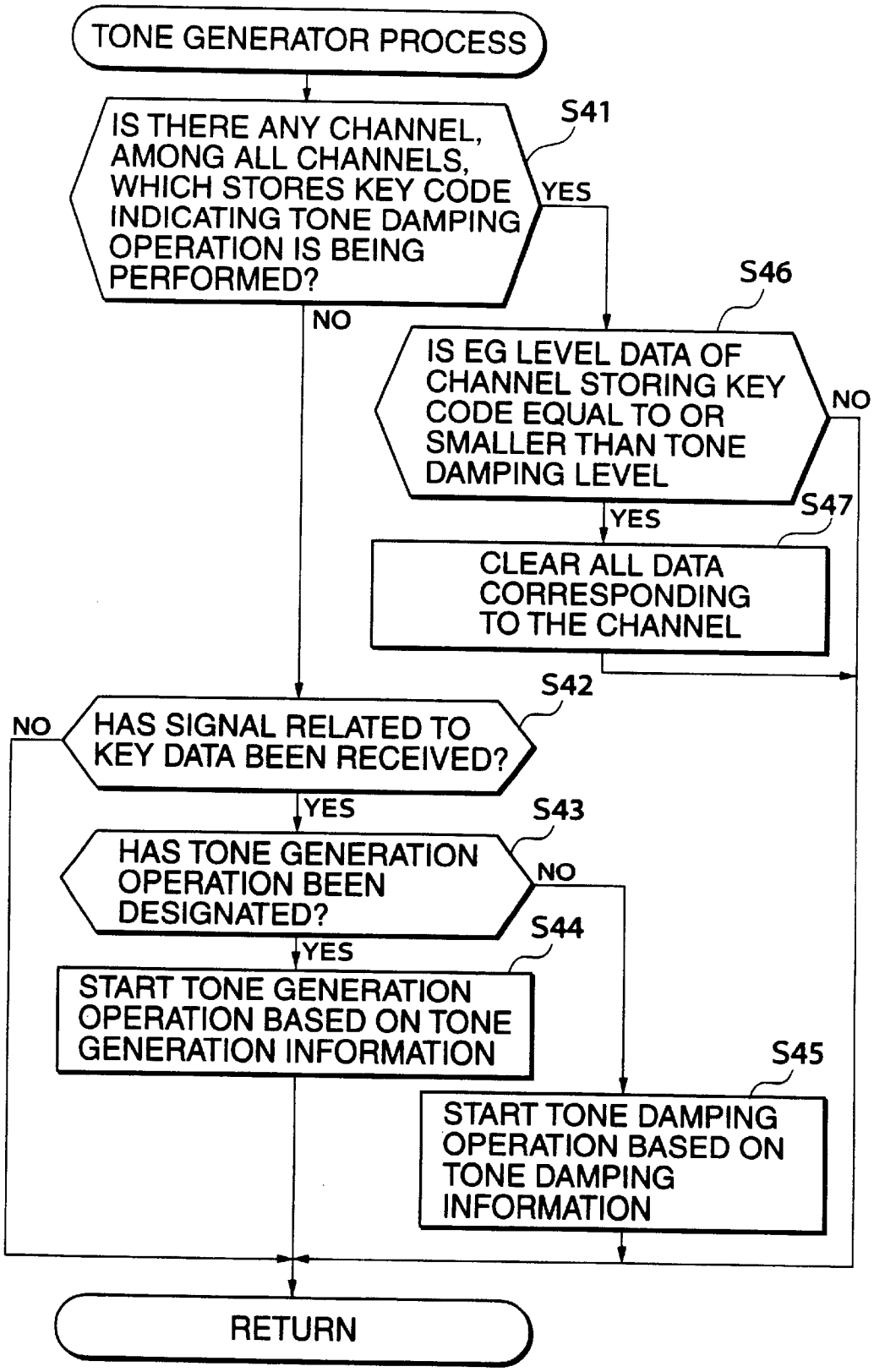
FIG. 11 is a flowchart showing in detail the procedure of a tone generator process subroutine appearing in FIG. 8.

FIG. 11 is a flowchart showing in detail the procedure of the tone generator process subroutine, which is executed at the step S4, as described before.

The tone generator process includes (i) an operation of causing the tone generator circuit 15 to start a tone generation operation, (ii) a tone damping operation, and (iii) an operation which, when an EG level of a tone generation channel CH for which a key code KC has been stored is equal to or lower than a tone damping level, is performed for clearing all data in areas corresponding to such channel CH in the buffers KEYBUF and TCBUF and in the counter areas Ton(n) and Toff(n).

In FIG. 11, the operation (i) of causing the tone generator circuit 15 to start a tone generation operation is executed by following a path of steps S41→S42→S43→S44→Return.

That is, when none of the tone generation channels has set therefor a key code indicating that a tone damping operation is being executed, there is received a signal related to key data, and at the same time "KEY-ON" (instruction for tone generation) is set, the CPU 5 instructs the tone generator circuit 15 to start a tone generation operation based on tone generation information. More specifically, the tone generation operation is initiated by instructing the tone generator circuit 15 to start a tone generation EG or by designating a tone color change parameter, for example.

The operation (iii) of causing the tone generator circuit 15 to start a tone damping operation is executed by following a path of steps S41→S42→S43→S45→Return.

That is, when none of the tone generation channels has set therefor a key code indicating that a tone damping operation is being executed, there is received a signal related to key data, and at the same time "KEYOFF" (instruction for tone damping), the CPU 5 causes the tone generator circuit 15 to start a tone damping operation based on tone damping information. More specifically, the tone damping operation is initiated by instructing the tone generator circuit 15 to start a tone damping EG or designating a tone color change parameter, for example. Since the tone generator circuit 15 is constructed mainly of hardware, the tone generator process is simple in the sense that it is performed by only instructing the tone generator circuit 15 to start a tone generation or tone damping operation. However, the tone generator circuit 15 may also be constructed mainly of software, and in this case, its procedure would become more complicated than that of the above described tone generator process. Since the tone generator process does not constitute an essential feature of the invention, its description is omitted.

Figure 12:
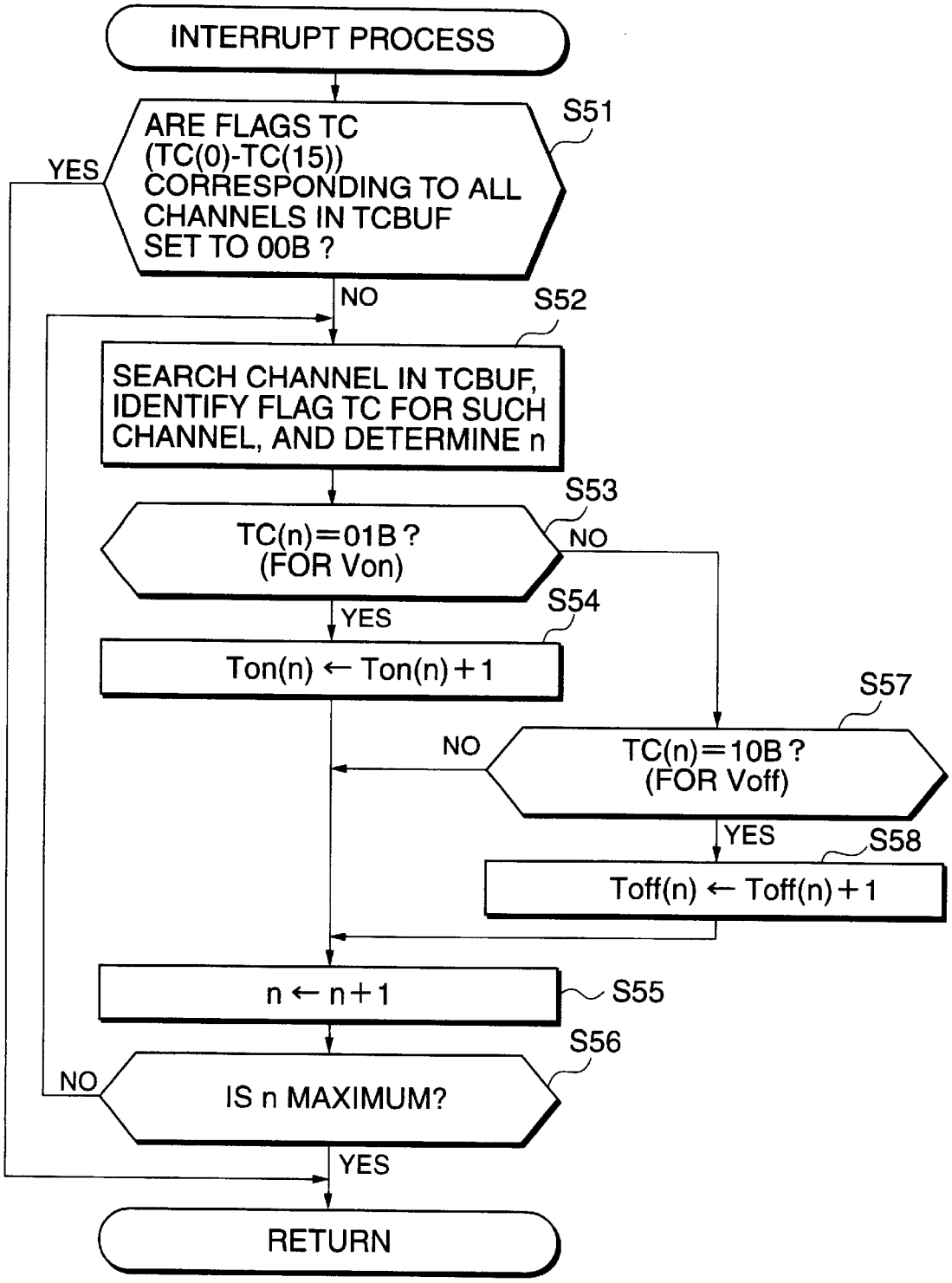
FIG. 12 is a flowchart showing in detail the procedure of a timer interrupt process.

FIG. 12 is a flowchart showing in detail the procedure of the timer interrupt process.

The timer interrupt process includes (i) an operation of measuring a key-on time, and (ii) an operation of measuring a key-off time. Whether one of the operations is to be executed or neither of them is to be executed is determined by a value set to a flag TC(ii) corresponding to a channel n in question.

As shown in FIG. 13C, any of three values, which are 00B, 01B and 10B, can be set to the flag TC(n). A value 11B is not used. These three values indicate the following states:

TC(n)=00B: Neither key-on time nor key-off time is measured;

TC(n)=01B: Key-on time is measured;

TC(n)=10B: Key-off time is measured.

In FIG. 12, the operation (i) of measuring a key-on time is executed by following a path of steps S51→S52→S53→S54→S55→S56→S52, while the operation (ii) of measuring a key-off time is executed by following a path of steps S51→S52→S53→ S57→ S58→S55→S56→S52.

Since the operation of each step could be easily understood from the flowchart shown in FIG. 12, its detailed description is omitted.

As described in the foregoing, the keyboard assembly 1 according to the present embodiment has such a structure as to allow occurrence of chattering due to a rebound of each mass member 40 to be suppressed, and thus the key process need not include a step for eliminating chattering. As a result, the algorithm for performing the key process can be simplified.

What is claimed is:

1. A keyboard assembly comprising:

a plurality of keys;

a plurality of mass members each disposed to be pivotally driven in response to depression of a corresponding one of said plurality of keys;

a support device that pivotally supports said plurality of keys and said mass members corresponding respectively to said keys; and a plurality of musical tone instruction devices that are provided respectively for said plurality of keys and each instruct generation and damping of a musical tone in response to depression of a corresponding one of said plurality of keys;

wherein said musical tone instruction devices each comprise a first sensor and a second sensor for generating a key event during a stroke of the corresponding one of said keys in response to depression of the corresponding one of said keys or in response to pivotal movement of a corresponding one of said mass members responsive to the depression of the corresponding one of said keys;

said first sensor being disposed to be activated in a first half of the stroke of the corresponding one of said keys to determine timing for damping of the musical tone;

said second sensor being disposed to be activated in a second half of the stroke of the corresponding one of said keys to determine timing for generation of the musical tone, said second sensor further determining timing for determining a velocity of the corresponding one of said keys depending on a position of the corresponding one of the keys during the stroke relative to said support device.

2. A keyboard assembly according to claim 1, wherein said first sensor is activated by the corresponding one of said keys, and said second sensor is activated by the corresponding one of said mass members.

3. A keyboard assembly according to claim 1, wherein said first sensor and said second sensor each comprise a contact unit having a plurality of contacts formed integrally thereon, said first sensor determining said timing for damping of the musical tone by detecting timing in which said plurality of contacts thereof coming into contact with each other, said second sensor determining said timing for generation of the musical tone and said timing for determining said velocity of the corresponding one of said keys by detecting timing in which said plurality of contacts thereof coming into contact with each other.

4. A keyboard assembly according to claim 1, wherein said first sensor and said second sensor each comprise a movable contact member formed of a resilient resin material and having a plurality of movable contacts formed thereon, and a fixed contact member having a plurality of fixed contacts formed thereon and arranged opposite to said movable contacts, respectively.

5. A keyboard assembly according to claim 4, wherein said fixed contact members of said first sensor and said second sensor are each mounted on a board member separate from a corresponding one of said first sensor and said second sensor.

6. A keyboard assembly according to claim 1, wherein said first sensor further determines timing for determining a musical tone damping velocity, depending on the position of the corresponding one of the keys during the stroke relative to said support device.

7. A keyboard assembly according to claim 6, wherein said first sensor and said second sensor each comprise a contact unit having a plurality of contacts formed integrally thereon, said first sensor determining said timing for damping of the musical tone and timing for determining said musical tone damping velocity by detecting timing in which said plurality of contacts thereof coming into contact with each other, said second sensor determining said timing for generation of the musical tone and said timing for determining said velocity of the corresponding one of said keys by detecting timing in which said plurality of contacts thereof coming into contact with each other.

8. A keyboard assembly according to claim 6, wherein said first sensor and said second sensor each comprise a movable contact member formed of a resilient resin material and having a plurality of movable contacts formed thereon, and a fixed contact member having a plurality of fixed contacts formed thereon and arranged opposite to said movable contacts, respectively.

9. A keyboard assembly according to claim 8, wherein said fixed contact members of said first sensor and said second sensor are each mounted on a board member separate from a corresponding one of said first sensor and said second sensor.

10. A keyboard assembly comprising:

a plurality of keys;

a plurality of mass members each disposed to be pivotally driven in response to depression of a corresponding one of said plurality of keys;

a support device that pivotally supports said plurality of keys and said mass members corresponding respectively to said keys; and a plurality of musical tone instruction devices that are provided respectively for said plurality of keys and each instruct generation and damping of a musical tone in response to depression of a corresponding one of said plurality of keys;

wherein said musical tone instruction devices each comprise a first sensor and a second sensor for generating a key event during a stroke of the corresponding one of said keys in response to depression of the corresponding one of said keys or in response to pivotal movement of a corresponding one of said mass members responsive to the depression of the corresponding one of said keys;

said first sensor being disposed to be activated in a first half of the stroke of the corresponding one of said keys to determine timing for damping of the musical tone;

said second sensor being disposed to be activated in a second half of the stroke of the corresponding one of said keys to determine timing for generation of the musical tone, said second sensor further determining timing for determining a velocity of the corresponding one of said keys depending on a position obtained by calculating a position of the corresponding one of said mass members during a depression stroke relative to said support device in terms of a position of the corresponding one of the keys.

11. A keyboard assembly according to claim 10, wherein said first sensor is activated by the corresponding one of said keys, and said second sensor is activated by the corresponding one of said mass members.

12. A keyboard assembly according to claim 10, wherein said first sensor and said second sensor each comprise a contact unit having a plurality of contacts formed integrally thereon, said first sensor determining said timing for damping of the musical tone by detecting timing in which said plurality of contacts thereof coining into contact with each other, said second sensor determining said timing for generation of the musical tone and said timing for determining said velocity of the corresponding one of said keys by detecting timing in which said plurality of contacts thereof coming into contact with each other.

13. A keyboard assembly according to claim 10, wherein said first sensor and said second sensor each comprise a movable contact member formed of a resilient resin material and having a plurality of movable contacts formed thereon, and a fixed contact member having a plurality of fixed contacts formed thereon and arranged opposite to said movable contacts, respectively.

14. A keyboard assembly according to claim 13, wherein said fixed contact members of said first sensor and said second sensor are each mounted on a board member separate from a corresponding one of said first sensor and said second sensor.

15. A keyboard assembly according to claim 10, wherein said first sensor further determines timing for determining a musical tone damping velocity, depending on the position of the corresponding one of the keys during the stroke relative to said support device.

16. A keyboard assembly according to claim 15, wherein said first sensor and said second sensor each comprise a contact unit having a plurality of contacts formed integrally thereon, said first sensor determining said timing for damping of the musical tone by detecting timing in which said plurality of contacts thereof coining into contact with each other, said second sensor determining said timing for generation of the musical tone and said timing for determining said velocity of the corresponding one of said keys by detecting timing in which said plurality of contacts thereof coming into contact with each other.

17. A keyboard assembly according to claim 15, wherein said first sensor and said second sensor each comprise a movable contact member formed of a resilient resin material and having a plurality of movable contacts formed thereon, and a fixed contact member having a plurality of fixed contacts formed thereon and arranged opposite to said movable contacts, respectively.

18. A keyboard assembly according to claim 17, wherein said fixed contact members of said first sensor and said second sensor are each mounted on a board member separate from a corresponding one of said first sensor and said second sensor.

19. A keyboard assembly comprising:

a plurality of keys;

a plurality of mass members each disposed to be pivotally driven in response to depression of a corresponding one of said plurality of keys;

a support device that pivotally supports said plurality of keys and said mass members corresponding respectively to said keys; and a plurality of musical tone instruction devices that are provided respectively for said plurality of keys and each instruct generation and damping of a musical tone in response to depression of a corresponding one of said plurality of keys;

wherein said musical tone instruction devices each comprise a first sensor and a second sensor for generating a key depression event or a key release event during a stroke of the corresponding one of said keys in response to depression of the corresponding one of said keys or in response to pivotal movement of a corresponding one of said mass members responsive to the depression of the corresponding one of said keys;

said first sensor being disposed to be activated in a first half of the stroke of the corresponding one of said keys to detect a third position which is a position of the corresponding one of said keys assumed during release;

said second sensor being disposed to be activated by the corresponding one of said mass members in a second half of the stroke of the corresponding one of said keys to detect a first position which is a position of the corresponding one of said keys assumed during depression, and detect a second position which is closer than said first position and farther from a position of the corresponding one of said keys in a released state than said third position;

said musical tone instruction devices each instructing generation of a corresponding musical tone when said second sensor detects said first position after detecting said second position, and preparing regeneration of the corresponding musical tone when said second sensor again detects said second position while generation of the corresponding musical tone is instructed.

20. A keyboard assembly comprising:

a plurality of keys;

a plurality of mass members each disposed to be pivotally driven in response to depression of a corresponding one of said plurality of keys;

a support device that pivotally supports said plurality of keys and said mass members corresponding respectively to said keys; and a plurality of sensor devices that are provided respectively for said plurality of keys and each instruct generation and damping of a musical tone in response to depression of a corresponding one of said plurality of keys;

wherein said sensor devices each comprises:

a first position signal generator driven in a second half of a stroke of a corresponding one of said keys, for generating a first position signal indicative of a first position of the corresponding one of said keys in which an instruction for generation of a musical tone is to be given during depression of the corresponding one of said keys, when the corresponding one of said keys is located in said first position;

a second position signal generator driven in said second half of the stroke of the corresponding one of said keys, for generating a second position signal indicative of a second position of the corresponding one of said keys in which a measurement of a depression velocity of the corresponding one of said keys is to be started during depression of the corresponding one of said keys, when the corresponding one of said keys is located in said second position; and a third position signal generator driven in a first half of the stroke of the corresponding one of said keys, for generating a third position signal indicative of a third position of the corresponding one of said keys in which an instruction for damping the musical tone is to be given during release of the corresponding one of said keys, when the corresponding one of said keys is located in said third position, said mass members being each arranged relative to said support device such that a limit position of the corresponding one of said keys in which the musical tone can be repeatedly generated due to a rebound of the mass member during generation of the musical tone is located farther from a position of the corresponding one of said keys in a released state than said second position.

21. A keyboard assembly according to claim 20, wherein said third position signal generator comprises a sensor driven by the corresponding one of said keys, and said first position signal generator and said second position signal generator each comprise a sensor driven by a corresponding one of said mass members.

22. A keyboard assembly according to claim 20, wherein said sensor devices each further comprise a fourth position signal generator driven in said first half of the stroke of the corresponding one of said keys, for generating a fourth signal indicative of a fourth position in which a measurement of a release velocity of the corresponding one of said keys is to be started during release of the corresponding one of said keys, when the corresponding one of said keys is located in said fourth position.

23. A keyboard assembly according to claim 20, wherein said first position is located farther from said position of the corresponding one of said keys in a released state than said second position, said mass members being each arranged relative to said support device such that said limit position of the corresponding one of said keys in which the musical tone can be repeatedly generated is located between said first position and said second position.

24. A keyboard assembly comprising:

a plurality of keys;

a plurality of mass members each disposed to be pivotally driven in response to depression of a corresponding one of said plurality of keys;

a support device that pivotally supports said plurality of keys and said mass members corresponding respectively to said keys; and a plurality of musical tone instruction devices that are provided respectively for said plurality of keys and each instruct generation and damping of a musical tone in response to depression of a corresponding one of said plurality of keys;

wherein said musical tone instruction devices each comprise a first touch sensor and a second touch sensor that generate a key event during a stroke of the corresponding one of said keys in response to pivotal movement of a corresponding one of said mass members responsive to depression of the corresponding one of said keys, said first and second touch sensors each having a moving part and a fixed part;

said second touch sensor being disposed to be activated in a second half of the stroke of the corresponding one of said keys, for generating a first timing related to musical tone generation, and a second timing related to musical tone generation corresponding to a shallower position of the corresponding one of said keys during the stroke than said first timing;

said first touch sensor determining timing related to musical tone damping corresponding to a shallower position of the corresponding one of said keys during the stroke than said first timing;

said moving part of at least one of said first and second touch sensors being driven by the corresponding one of said mass members; and said fixed part of said first touch sensor and said fixed part of said second touch sensor being arranged respectively on separate boards.

25. A keyboard assembly comprising:

a plurality of keys;

a plurality of mass members each disposed to be pivotally driven in response to depression of a corresponding one of said plurality of keys;

a support device that pivotally supports said plurality of keys and said mass members corresponding respectively to said keys; and a plurality of musical tone instruction devices that are provided respectively for said plurality of keys and each instruct generation and damping of a musical tone in response to movement of a corresponding one of said plurality of keys;

wherein said musical tone instruction devices each comprises a first sensor and a second sensor for generating a key event during a stroke of the corresponding one of said keys or in response to pivotal movement of a corresponding one of said mass members responsive to the depression of the corresponding one of said keys; and wherein one of said first sensor and said second sensor is activated by the corresponding one of said keys, and the other is activated by the corresponding one of said mass members.

26. A keyboard assembly according to claim 25, further comprising a touch response signal generator that generates a touch response signal based on outputs from said first and second sensors, and a controller that controls a corresponding one of said musical tone instruction devices based on the generated touch response signal.

27. A keyboard assembly comprising:

a plurality of keys;

a plurality of mass members each disposed to be pivotally driven in response to depression of a corresponding one of said plurality of keys;

a support device that pivotally supports said plurality of keys and said mass members corresponding respectively to said keys; and a plurality of musical tone instruction devices that are provided respectively for said plurality of keys and each instruct generation and damping of a musical tone in response to movement of a corresponding one of said plurality of keys;

wherein said musical tone instruction devices each comprises a first sensor and a second sensor for generating a key event during a stroke of the corresponding one of said keys or in response to pivotal movement of a corresponding one of said mass members responsive to depression of the corresponding one of said keys; and wherein said first sensor comprises a sensor driven by the corresponding one of said keys, for detecting release of the corresponding one of said keys, and said second sensor comprises a sensor driven by a corresponding one of the said mass members, for detecting depression of the corresponding one of said keys.

28. A keyboard assembly according to claim 27, further comprising a touch response signal generator that generates a touch response signal based on outputs from said first and second sensors, and a controller that controls a corresponding one of said musical tone instruction devices based on the generated touch response signal.

29. A keyboard assembly comprising;

a plurality of keys;

a plurality of mass members each disposed to be pivotally driven in response to depression of a corresponding one of said plurality of keys;

a support device that pivotally supports said plurality of keys and said mass members corresponding respectively to said keys; and a plurality of musical tone instruction devices that are provided respectively for said plurality of keys and each instruct generation and control of a musical tone in response to movement of a corresponding one of said plurality of keys and a corresponding one of said mass members;

wherein said musical tone instruction devices each comprise a first sensor and a second sensor for generating a key event during a stroke of the corresponding one of said keys in response to depression of the corresponding one of said keys or in response to pivotal movement of the corresponding one of said mass members responsive to the depression of the corresponding one of said keys;

wherein one of said first sensor and said second sensor is activated by the corresponding one of said keys, and the other is activated by the corresponding one of said mass members; and wherein outputs from said first and second sensors cooperate to generate a touch response signal, based on which a corresponding one of said musical tone instruction devices instructs generation and control of said musical tone.

30. A keyboard assembly according to claim 29, wherein said first sensor is activated by the corresponding one of said keys, for detecting release of the corresponding one of said keys, and said second sensor is activated by the corresponding one of said mass members, for detecting depression of the corresponding one of said keys.

* * * * *